US008419003B2

(12) United States Patent
Kojima et al.

(10) Patent No.: US 8,419,003 B2
(45) Date of Patent: Apr. 16, 2013

(54) CREASING DEVICE AND IMAGE FORMING SYSTEM

(75) Inventors: Hidetoshi Kojima, Miyagi (JP); Naoyuki Ishikawa, Kanagawa (JP); Naohiro Kikkawa, Kanagawa (JP); Hitoshi Hattori, Tokyo (JP); Takashi Saito, Kanagawa (JP); Shuuya Nagasako, Kanagawa (JP); Yuusuke Shibasaki, Kanagawa (JP); Akihiro Musha, Kanagawa (JP); Naoki Oikawa, Miyagi (JP); Go Aiba, Miyagi (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/324,010

(22) Filed: Dec. 13, 2011

(65) Prior Publication Data

US 2012/0147388 A1 Jun. 14, 2012

(30) Foreign Application Priority Data

Dec. 13, 2010 (JP) ..... 2010-277278

(51) Int. Cl.
*B31F 1/08* (2006.01)

(52) U.S. Cl.
USPC ..... 270/45; 270/58.07

(58) Field of Classification Search ..... 270/32, 270/45, 58.07; 493/59, 240, 242, 355, 396, 493/397
See application file for complete search history.

(56) References Cited

U.S. PATENT DOCUMENTS 5,221,249 A * 6/1993 Simpson ..... 493/354
5,709,376 A * 1/1998 Ushirogata ..... 270/58.11
7,597,311 B2 * 10/2009 Kawata et al. ..... 270/37
7,913,988 B2 * 3/2011 Awano ..... 270/45
7,954,797 B2 * 6/2011 Sasahara ..... 270/45
2010/0207314 A1 8/2010 Hattori et al.
2011/0076081 A1 3/2011 Hattori et al.
2011/0130260 A1 6/2011 Kikkawa et al.
2011/0245055 A1 10/2011 Saito et al.
2011/0301005 A1 12/2011 Hattori et al.
2011/0301008 A1 12/2011 Shibasaki et al.

FOREIGN PATENT DOCUMENTS

JP 4213603 B2 9/2005
JP 4506836 B2 7/2009
JP 4787897 B2 3/2011

OTHER PUBLICATIONS

Abstract of JP 2011-057438 published Mar. 24, 2011.
Abstract of JP 2009-166928 published Jul. 30, 2009.
Abstract of JP 2005-239312 published Sep. 8, 2005.

* cited by examiner

*Primary Examiner* — Leslie A Nicholson, III
(74) *Attorney, Agent, or Firm* — Harness, Dickey & Pierce, P.L.C.

(57) ABSTRACT

A creasing device, that forms a crease on a sheet, includes: a first member, extending in a direction perpendicular to a sheet conveying direction, on which a convex blade is formed; a second member on which a groove-like concave blade is formed such that the convex blade can be fitted into the concave blade by interposing the sheet therebetween; a drive unit that causes the first and the second members to interpose, therebetween, the sheet to form a crease on the sheet; a sheet-information acquiring unit that acquires first sheet information of the sheet to be creased; an adjusting unit that adjusts a pressing force exerted by the drive unit; and a control unit that sets the pressing force to an optimum pressing force for the sheet and that causes the drive unit to drive the first and the second members for creasing the sheet at the optimum pressing force.

7 Claims, 18 Drawing Sheets

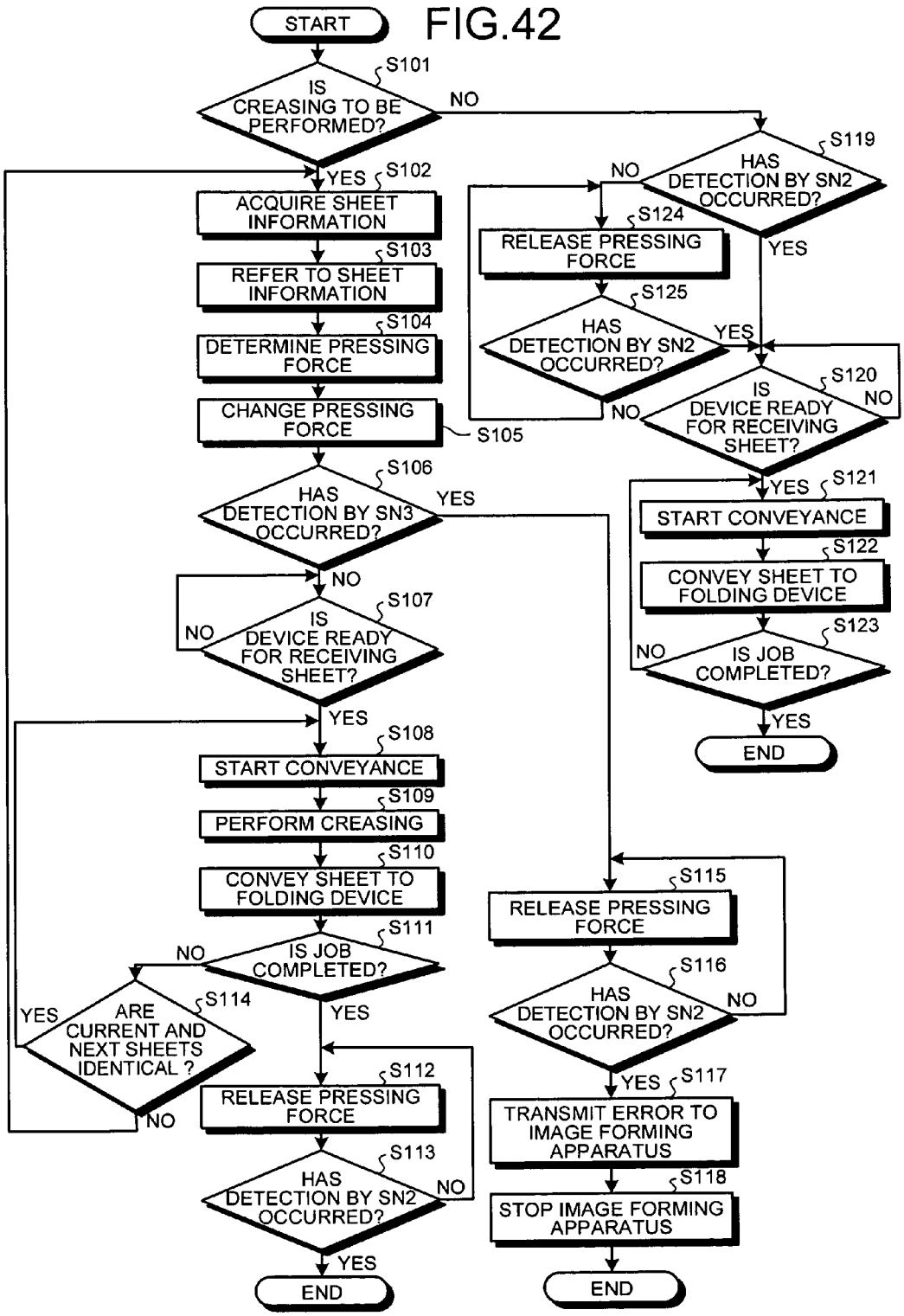
FIG.42
START
S101
IS CREASING TO BE PERFORMED?
NO
YES
S102
ACQUIRE SHEET INFORMATION
S103
REFER TO SHEET INFORMATION
S104
DETERMINE PRESSING FORCE
CHANGE PRESSING FORCE
S105
S106
HAS DETECTION BY SN3 OCCURRED?
YES
NO
S107
IS DEVICE READY FOR RECEIVING SHEET?
NO
YES
S108
START CONVEYANCE
S109
PERFORM CREASING
S110
CONVEY SHEET TO FOLDING DEVICE
S111
IS JOB COMPLETED?
NO
YES
S114
ARE CURRENT AND NEXT SHEETS IDENTICAL ?
YES
NO
S112
RELEASE PRESSING FORCE
S113
HAS DETECTION BY SN2 OCCURRED?
NO
YES
END
S119
HAS DETECTION BY SN2 OCCURRED?
NO
YES
S124
RELEASE PRESSING FORCE
S125
HAS DETECTION BY SN2 OCCURRED?
YES
NO
S120
IS DEVICE READY FOR RECEIVING SHEET?
NO
YES
S121
START CONVEYANCE
S122
CONVEY SHEET TO FOLDING DEVICE
S123
IS JOB COMPLETED?
NO
YES
END
S115
RELEASE PRESSING FORCE
S116
HAS DETECTION BY SN2 OCCURRED?
NO
YES
S117
TRANSMIT ERROR TO IMAGE FORMING APPARATUS
S118
STOP IMAGE FORMING APPARATUS
END

CREASING DEVICE AND IMAGE FORMING SYSTEM

CROSS-REFERENCE TO RELATED APPLICATIONS

The present application claims priority to and incorporates by reference the entire contents of Japanese Patent Application No. 2010-277278 filed in Japan on Dec. 13, 2010.

BACKGROUND OF THE INVENTION

1. Field of the Invention

The present invention relates to a creasing device that forms a crease (folding crease) on a sheet-like member (hereafter, referred to as a "sheet") at an intended position before the sheet is folded and an image forming system that includes the creasing device and an image forming apparatus.

2. Description of the Related Art

Conventionally, what is called as saddle-stitched or center-folded booklet production has been performed. The saddle-stitched booklet production is performed by saddle stitching a sheet bundle, which is a stack of a plurality of sheets discharged from an image forming apparatus, and folding the saddle-stitched sheet bundle at a middle portion of the sheet bundle. Folding a sheet bundle including a plurality of sheets causes an outer sheet of the sheet bundle to be stretched at a crease by a greater amount than an inner sheet. An image portion at the crease on the outer sheet may thus be stretched, resulting in damage, such as come off of toner, to the image portion. A similar phenomenon can occur when another kind of folding, such as Z-folding or triple folding, is performed. There is also a case where folding is insufficiently performed due to thickness of a sheet bundle.

There is a well known technology for preventing toner from coming off using a creasing device. The creasing device creases a sheet bundle prior to a folding process where the sheet bundle is folded in two-folding or the like to make an outer sheet easy to be folded. The creasing device typically forms a crease on a sheet in a direction perpendicular to a sheet conveying direction by moving a roller on a sheet, irradiating a laser beam on a sheet, pressing a creasing blade against a sheet, or the like.

A known example of a creasing device is disclosed in Japanese Patent Application Laid-open No. 2009-166928. In Japanese Patent Application Laid-open No. 2009-166928, a technology is disclosed for moving a creasing member by using a plurality of individually-advancing-and-retracting mechanisms, which are activated at different times so as to press a sheet by the creasing member with a gradually-decreasing amount of pressing for producing a crease.

However, producing a crease on a sheet with a roller involves movement of the roller across a length of the sheet in a direction along which the sheet is to be folded, and therefore is time consuming. This can be resolved by rotating the sheet conveying direction by 90 degrees and producing a crease parallel to the sheet conveying direction; however, this scheme involves a change in footprint and therefore is disadvantageous from a viewpoint of space saving. Creasing by using a laser beam is environmentally less favorable because smoke and odor are emitted during creasing.

A device that creases a sheet by pressing a creasing blade against the sheet can form a crease in a direction perpendicular to a sheet conveying direction in a relatively short period of time and easily. A required magnitude of pressing force for the creasing varies depending on a sheet type, a sheet size, or a sheet thickness. However, it is difficult to change the magnitude of the pressing force to be applied from the creasing blade for creasing. Accordingly, the pressing force is typically set to a highest pressing force among forces needed for sheets to be processed. This inevitably results in an increase in a driving load of the creasing blade. As the driving load increases, the device is upsized. Accordingly, loads placed on other parts are increased, making it necessary to increase strengths of the other parts. Furthermore, long-term use of the device can also cause a problem in reliability. Furthermore, when a large load is placed on a thin sheet that does not need a large load, an excessively deep crease is formed, resulting in a problem in quality.

There is a need that a crease can be formed on a sheet serving as a target for creasing with a minimum driving load.

SUMMARY OF THE INVENTION

It is an object of the present invention to at least partially solve the problems in the conventional technology.

A creasing device that forms a crease on a sheet includes: a first member, extending in a direction perpendicular to a sheet conveying direction, on which a convex blade having a convex cross section is formed; a second member, provided at a position to face the first member, on which a groove-like concave blade is formed such that the convex blade can be fitted into the concave blade by interposing the sheet therebetween; a drive unit that causes the first member and the second member to be relatively in contact with and separated from each other so as to interpose, therebetween, the sheet that has been stopped at a predetermined position and to form a crease on the sheet; a sheet-information acquiring unit that acquires first sheet information of the sheet to be creased; a first adjusting unit that adjusts a pressing force exerted by the drive unit; and a control unit that sets the pressing force of the first adjusting unit to an optimum pressing force for the sheet to be creased based on the first sheet information acquired by the sheet-information acquiring unit and that causes the drive unit to drive the first member and the second member for creasing the sheet at the optimum pressing force.

An image forming system includes: a creasing device that forms a crease on a sheet and an image forming apparatus that forms an image on the sheet. The creasing device includes: a first member, extending in a direction perpendicular to a sheet conveying direction, on which a convex blade having a convex cross section is formed; a second member, provided at a position to face the first member, on which a groove-like concave blade is formed such that the convex blade can be fitted into the concave blade by interposing the sheet therebetween; a drive unit that causes the first member and the second member to be relatively in contact with and separated from each other so as to interpose, therebetween, the sheet that has been stopped at a predetermined position and to form a crease on the sheet; a sheet-information acquiring unit that acquires first sheet information of the sheet to be creased; a first adjusting unit that adjusts a pressing force exerted by the drive unit; and a control unit that sets the pressing force of the first adjusting unit to an optimum pressing force for the sheet to be creased based on the first sheet information acquired by the sheet-information acquiring unit and that causes the drive unit to drive the first member and the second member for creasing the sheet at the optimum pressing force.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 42 is a flowchart illustrating a process procedure of operations for controlling the pressing force and creasing according to the embodiment.

DETAILED DESCRIPTION OF THE PREFERRED EMBODIMENTS

Figure 1:
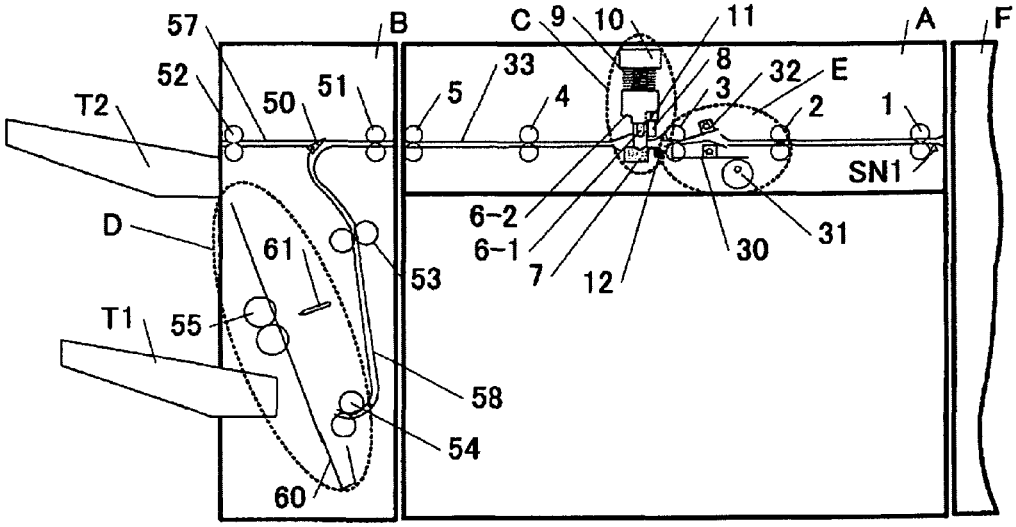
FIG. 1 is a diagram illustrating a schematic configuration of an image forming system according to an embodiment of the present invention.

According to an aspect of the embodiment, a pressing force to be applied to a sheet serving as a target for creasing is adjusted depending on the sheet, thereby reducing a driving load to be applied to a creasing blade during a creasing operation or setting the driving load to an appropriate value as the load.

Exemplary embodiments are described in detail below with reference to the accompanying drawings. Equivalent elements are denoted by the same reference numerals and symbols below, and repeated descriptions are omitted as appropriate.

FIG. 1 is a diagram illustrating a schematic configuration of an image forming system according to an embodiment. The image forming system according to the embodiment includes the image forming apparatus F that forms an image on a sheet of paper, a creasing device A that creases the sheet, and the folding device B that folds the sheet at a predetermined position of the sheet.

The image forming apparatus F forms a visible image pertaining to image data input from a scanner, a personal computer (PC), or the like on the sheet. The image forming apparatus F uses a known print engine of an electrophotographic type, a droplet ejection type, or the like.

The creasing device A includes a conveyance path 33, first to fifth conveying roller pairs 1 to 5 provided along the conveyance path 33 from an upstream side to a downstream side in a sheet conveying direction, an entrance sensor SN1 provided for detecting a sheet at an entrance of a device, which is on the upstream side of the first conveying roller pair 1, a creasing unit C provided between the third conveying roller pair 3 and the fourth conveying roller pair 4, and a skew correcting unit E provided in a vicinity of the creasing unit C in the sheet conveying direction.

The creasing unit C includes a creasing blade 6-1, a creasing support member 6-2, a receiving member 7, a sheet pressing member 8, an elastic member 9 that applies a pressing force to the creasing blade 6-1, a spring fixing member 10, a spring 11 that applies a pressing force to the sheet pressing member 8, and a receiving portion 12 that receives the pressing force from the sheet pressing member 8. The skew correcting unit E includes an abutting plate 30, an abutting-plate driving cam 31, and a conveyance guide plate 32. A sheet is interposed between the creasing blade 6-1 and the receiving member 7, and a concave crease is formed on the sheet by the creasing blade 6-1.

The folding device B includes a sheet-discharging conveyance path 57, a processing conveyance path 58, sixth to ninth conveying rollers 51 to 54, and a processing unit D. The processing unit D includes a trailing-edge fence 60, folding rollers 55, a folding plate 61, a first stacking tray T1, and a second stacking tray T2. A path-switching flap 50 for use in switching conveyance between the sheet-discharging conveyance path 57 and the processing conveyance path 58 is provided at a branching portion into the sheet-discharging conveyance path 57 and the processing conveyance path 58. The seventh conveying rollers 52 serving as sheet discharging rollers are provided on the most downstream side of the sheet-discharging conveyance path 57.

Basic sheet conveyance operations to be performed in the image forming system illustrated in FIG. 1, from a step of receiving a sheet discharged from the image forming apparatus F to a step of discharging and stacking the sheet onto the stacking tray T1 or T2 are described below.

1) A sheet P conveyed from the image forming apparatus F into the creasing device A passes by the entrance sensor SN1. Subsequently, the first to the fifth conveying rollers 1 to 5 start rotating based on detection information output from the entrance sensor SN1, and the first and the second conveying rollers 1 and 2 convey the sheet P to the skew correcting unit E.

The skew correcting unit E performs operations differently depending on whether or not skew correction is to be performed.

1-1) Situation where Skew Correction is not Performed

Figure 2:
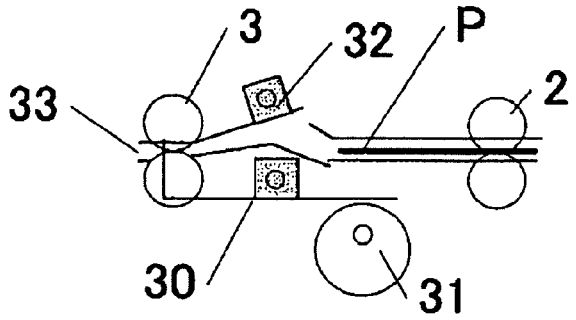
FIG. 2 is a schematic explanatory diagram of an operations to be performed by a skew correcting unit in a situation where skew correction is not performed and illustrating a state in which a leading edge of a sheet is on immediate upstream of a stopper plate.
Figure 3:
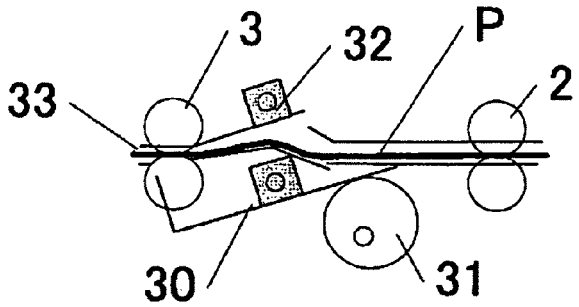
FIG. 3 is a schematic explanatory diagram of the operations to be performed by the skew correcting unit in the situation where skew correction is not performed and illustrating a state in which the leading edge of the sheet has passed over the stopper plate.

FIG. 2 and FIG. 3 are schematic diagrams illustrating operations in a situation where skew correction is not performed. In the situation where skew correction is not performed, after the sheet P has been conveyed to the second conveying rollers 2 as illustrated in FIG. 2, the abutting-plate driving cam 31 rotates, causing the abutting plate 30 to retract from the conveyance path 33 as illustrated in FIG. 3. Thereafter, the sheet P is conveyed to the third conveying roller 3 and then is further conveyed to processing units provided in downstream. During the conveyance, a conveyance speed of the second conveying rollers 2 and that of the third conveying roller 3 become equal to each other.

1-2) Situation where Skew Correction is to be Performed

Figure 4:
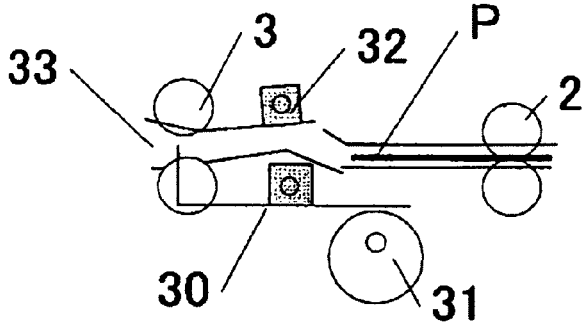
FIG. 4 is a schematic explanatory diagram of operations performed by the skew correcting unit in a situation where skew correction is performed and illustrating a state in which a leading edge of a sheet is on immediate upstream of the stopper plate and pressure on third conveying roller is released and the third conveying roller is at standby.
Figure 5:
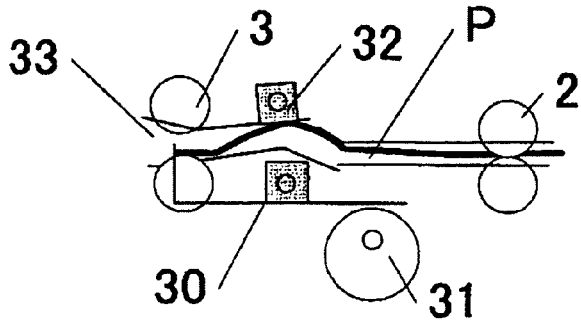
FIG. 5 is a schematic explanatory diagram of the operations to be performed by the skew correcting unit in the situation where skew correction is performed and illustrating a state in which the leading edge of the sheet has abutted on the stopper plate.

FIG. 4 to FIG. 9 are schematic diagrams illustrating operations to be performed in a situation where skew correction is performed. In the situation where skew correction is performed, when the sheet P has been conveyed to the second conveying rollers 2, the third conveying roller 3 is at a standby state in which the third conveying roller 3 is released from a pressure contact as illustrated in FIG. 4. When the sheet P is further conveyed and caused to abut on the abutting plate 30 by the second conveying rollers 2 as illustrated in FIG. 5, the sheet P bends and hence is subjected to skew correction.

Figure 6:
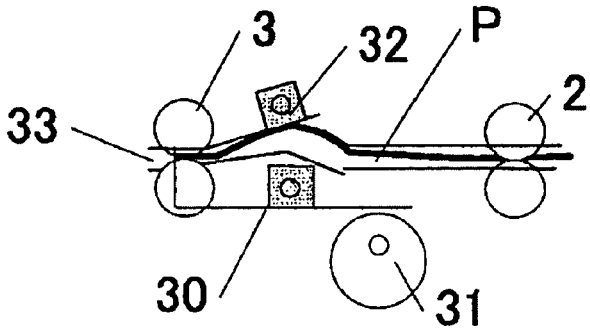
FIG. 6 is a schematic explanatory diagram of the operations to be performed by the skew correcting unit in the situation where skew correction is performed and illustrating a state in which the leading edge of the sheet has abutted on the stopper plate and, after completion of skew correction, pressure is applied to the third conveying roller.
Figure 7:
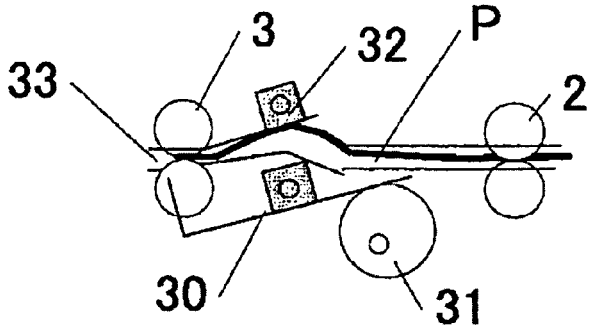
FIG. 7 is a schematic explanatory diagram of the operations to be performed by the skew correcting unit in the situation where skew correction is performed and illustrating a state, subsequent to the state in FIG. 6, where the stopper plate has retracted from a conveyance path.
Figure 8:
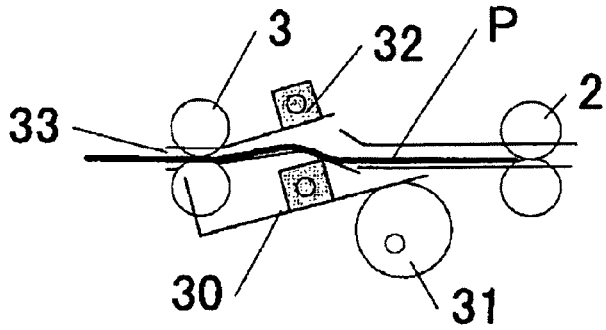
FIG. 8 is a schematic explanatory diagram of the operations to be performed by the skew correcting unit in the situation where skew correction is performed and illustrating a state, subsequent to the state in FIG. 7, where the sheet is being conveyed.
Figure 9:
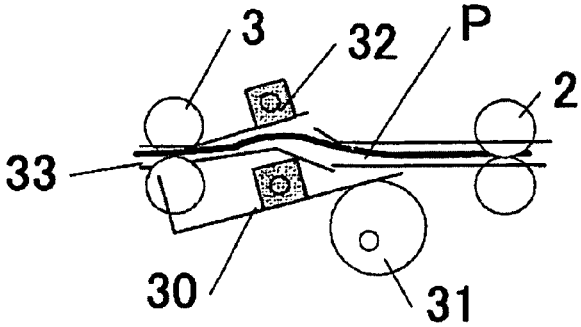
FIG. 9 is a schematic explanatory diagram of the operations to be performed by the skew correcting unit in the situation where skew correction is performed and illustrating a state, subsequent to the state in FIG. 8, where the sheet is conveyed solely by the third conveying roller and thus bending of the sheet is removed.

After completion of the skew correction, the third conveying roller 3 is brought into a pressure contact as illustrated in FIG. 6, causing the abutting plate 30 to retract from the conveyance path 33 as illustrated in FIG. 7. After the abutting plate 30 has been retracted, the sheet P is conveyed downstream by the second and the third conveying rollers 2 and 3 as illustrated in FIG. 8. After the sheet P has passed through the second conveying rollers 2, the sheet P is conveyed only by the third conveying roller 3 as illustrated in FIG. 9, and the bending of the sheet P is resolved.

Meanwhile, the conveyance guide plate 32 is lifted up and down following ascending and descending motions of the third conveying roller 3, as illustrated in the upper portions in FIGS. 4 to 9, thereby opening and closing the conveyance path 33.

2) Operations after Skew Correction

After passing through the skew correcting unit E, the sheet P reaches the creasing unit C. The creasing unit C operates differently depending on whether creasing is to be performed.

2-1) Situation where Creasing is not Performed

Figure 12:
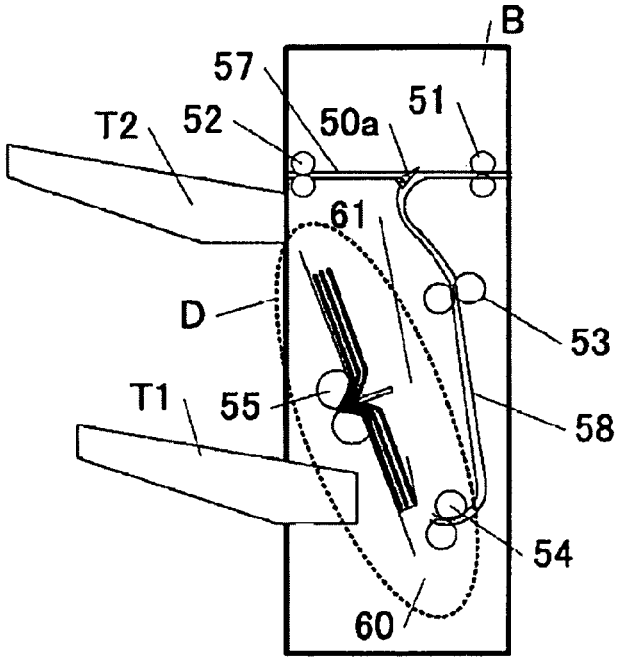
FIG. 12 is a schematic explanatory diagram of the operations to be performed in the situation where the folding device performs folding and illustrating a state in which a sheet bundle stacked on the processing tray is being center folded.
Figure 13:
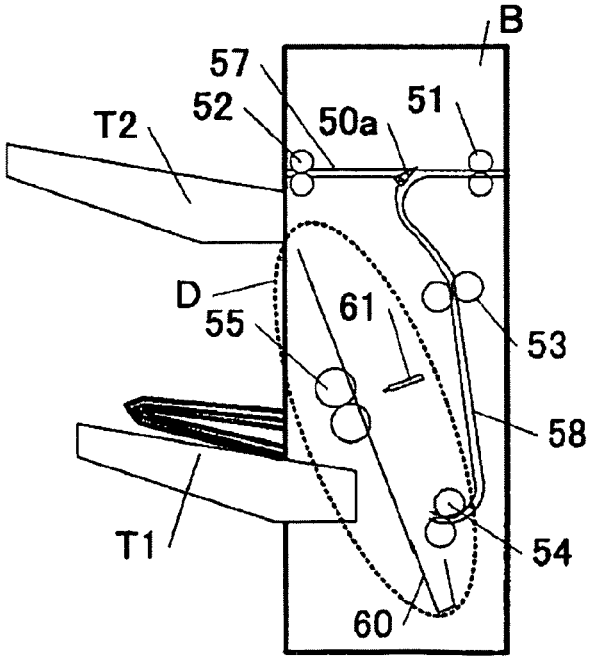
FIG. 13 is a schematic explanatory diagram of the operations to be performed in the situation where the folding device performs folding and illustrating a state in which the center-folded sheet bundle has been discharged onto a stacking tray.
Figure 14:
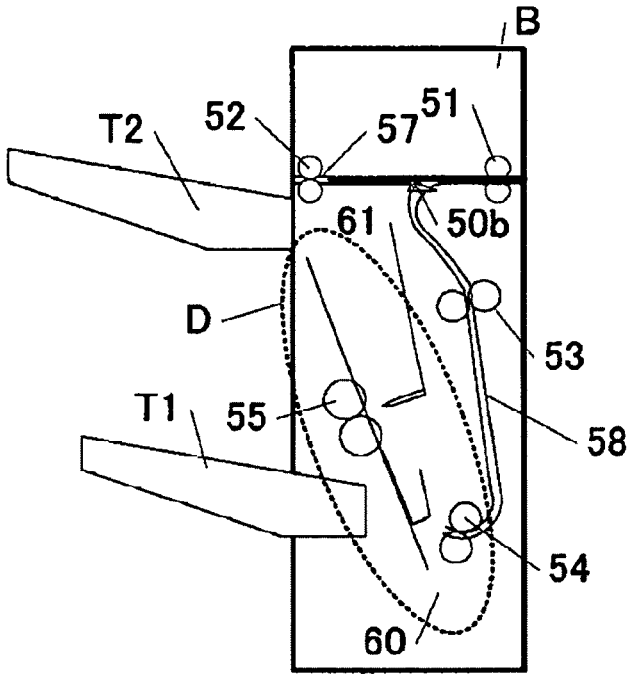
FIG. 14 is a schematic explanatory diagram of operations to be performed in a situation where the folding device does not perform folding and illustrating a state in which a sheet is conveyed through a sheet-output conveyance path.
Figure 15:
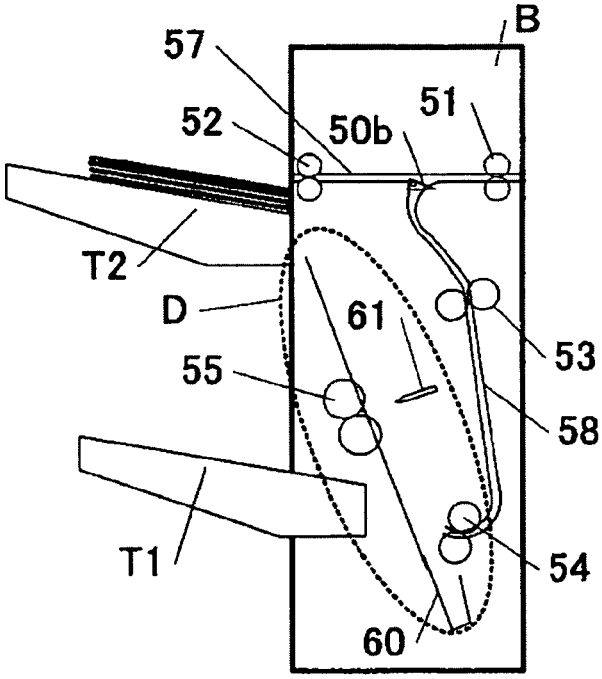
FIG. 15 is a schematic explanatory diagram of the operations to be performed in the situation where the folding device does not perform folding and illustrating a state in which the sheet is discharged through the sheet-output conveyance path to the stacking tray and stacked thereon.

FIG. 10 to FIG. 13 are schematic explanatory diagrams of operations in a situation where the folding device B performs folding. FIG. 14 and FIG. 15 are schematic diagrams illustrating operations in a situation where folding is not performed.

Figure 10:
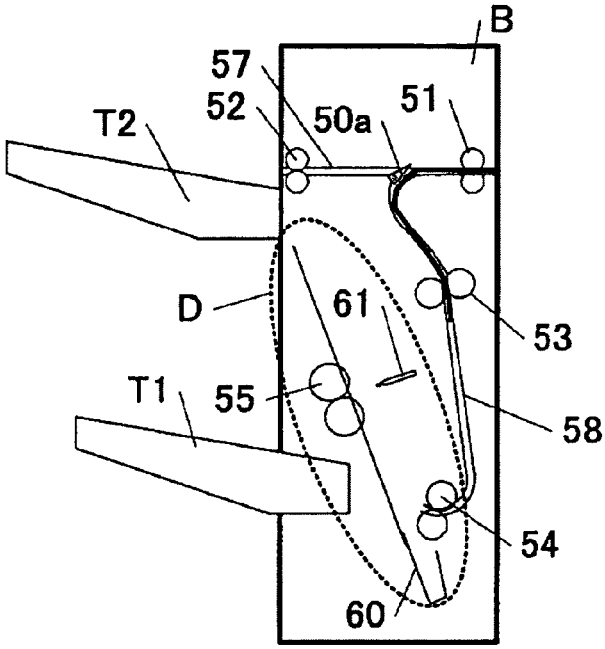
FIG. 10 is a schematic explanatory diagram of operations to be performed in a situation where a folding device performs folding and illustrating a state in which a path-switching flap is actuated to guide a sheet to a processing conveyance path.

After passing through the skew correcting unit E, the sheet P is conveyed to the folding apparatus B by the fourth and the fifth conveying rollers 4 and 5. When the sheet P is to be conveyed to the folding apparatus B to undergo folding, the path-switching flap 50 is in a position 50*a* where the path-switching flap 50 closes the sheet-discharging conveyance path 57 and opens the processing conveyance path 58 as illustrated in FIG. 10. Hence, the sheet P is guided to the processing conveyance path 58 by the path-switching flap 50.

Figure 11:
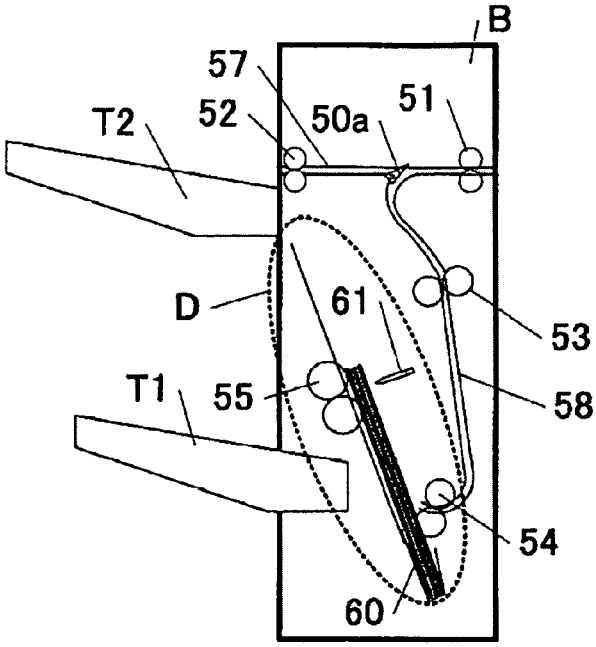
FIG. 11 is a schematic explanatory diagram of the operations to be performed in the situation where the folding device performs folding and illustrating a state in which all sheets have been conveyed through the processing conveyance path and stacked on a processing tray.

Thereafter, the sheet P is conveyed to the folding unit D by the eighth and the ninth conveying rollers 53 and 54 and stacked on the processing tray as illustrated in FIG. 11. The stacked sheet P is conveyed (lifted up) by the trailing-edge fence 60 to a folding position. The sheet P is pushed into a nip between the folding rollers 55 by the folding plate 61 as illustrated in FIG. 12, to thus be folded by the folding roller 55. Thereafter, the sheet P is discharged onto the stacking tray T1 as illustrated in FIG. 13.

In the situation where folding is not performed, the path-switching flap 50 is in a position 50*b* where the path-switching flap 50 opens the sheet-discharging conveyance path 57 and closes the processing conveyance path 58 as illustrated in FIG. 14. This causes the sheet P to be discharged through the sheet-discharging conveyance path 57 onto the stacking tray T2 by the seventh conveying rollers 52.

2-2) Situation where Creasing is Performed

To ensure creasing quality, it is preferable that skew correction is performed on every sheet that is to be creased. Note that a user can configure settings so as not to perform skew correction.

Figure 16:
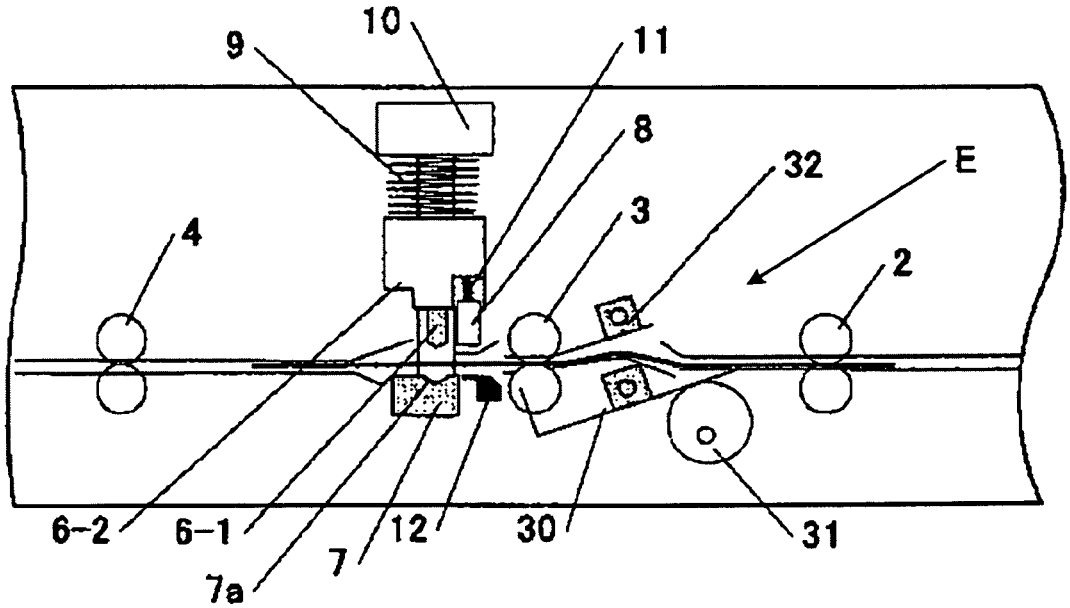
FIG. 16 is a schematic explanatory diagram of creasing operations and illustrating a state in which a sheet having undergone skew correction is conveyed toward a creasing unit by a specified distance.
Figure 17:
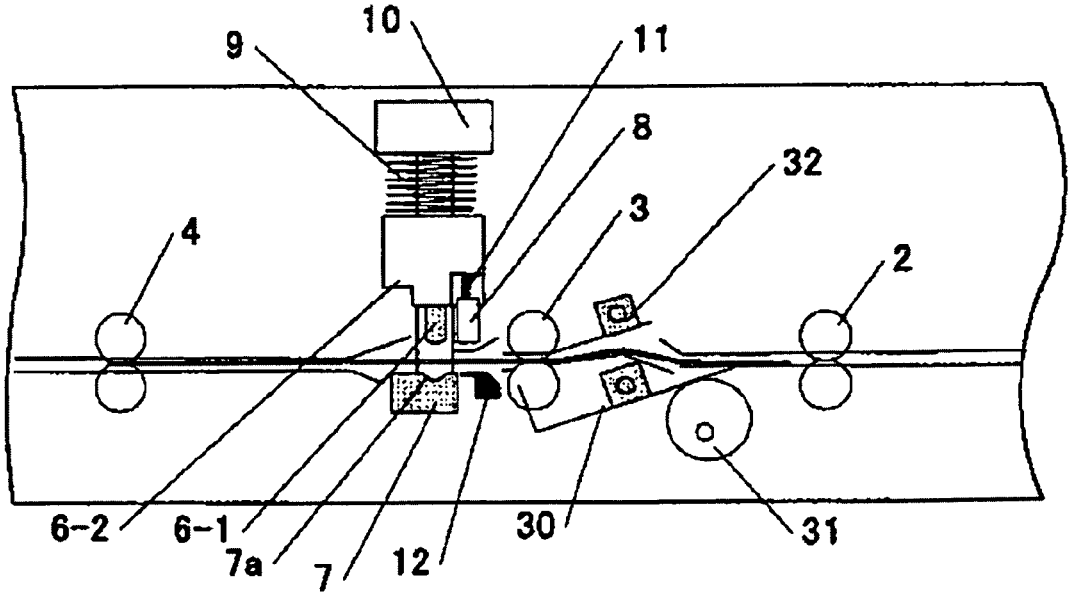
FIG. 17 is a schematic explanatory diagram of the creasing operations and illustrating a state in which the sheet having undergone skew correction is conveyed to a creasing position and stopped.
Figure 18:
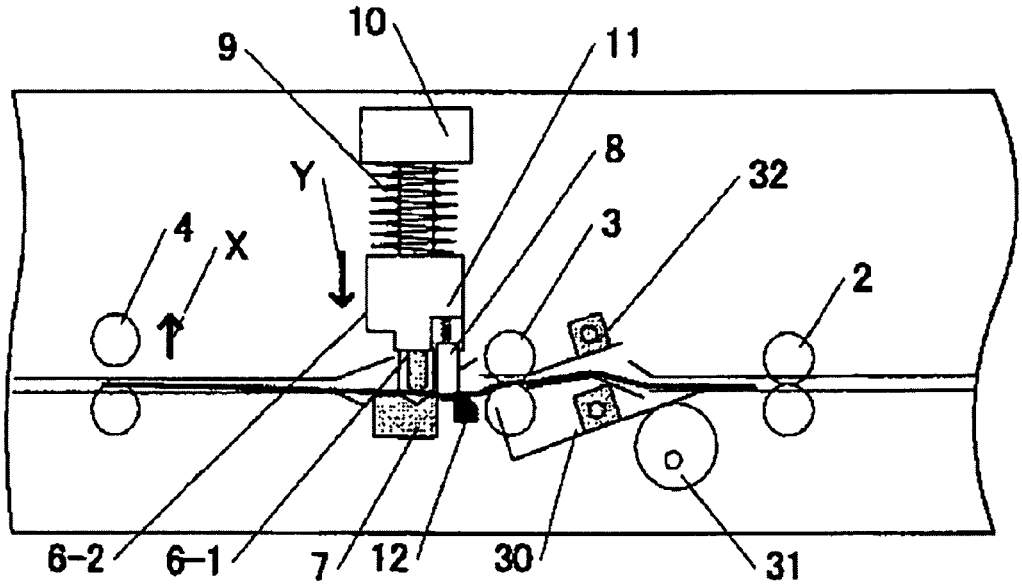
FIG. 18 is a schematic explanatory diagram of the creasing operations and illustrating a state in which, after a sheet pressing member has made a contact with the sheet stopped at the creasing position, fourth conveying roller is released from a pressure contact.

FIG. 16 to FIG. 21 are schematic diagrams illustrating creasing operations. As illustrated in FIG. 16, after skew correction, the sheet P is conveyed into the creasing unit C by the third conveying roller 3 by a specified distance with reference to the abutting plate 30. When the sheet P has been conveyed to a creasing position as illustrated in FIG. 17, the sheet P is stopped. When the sheet P is stopped, the creasing blade 6-1 is lowered in a direction indicated by arrow Y as illustrated in FIG. 18. After the sheet pressing member 8 has made a contact with the sheet P, an upper roller of the fourth conveying rollers 4 ascends as indicated by arrow X, releasing the fourth conveying rollers 4 from a pressure contact.

Figure 19:
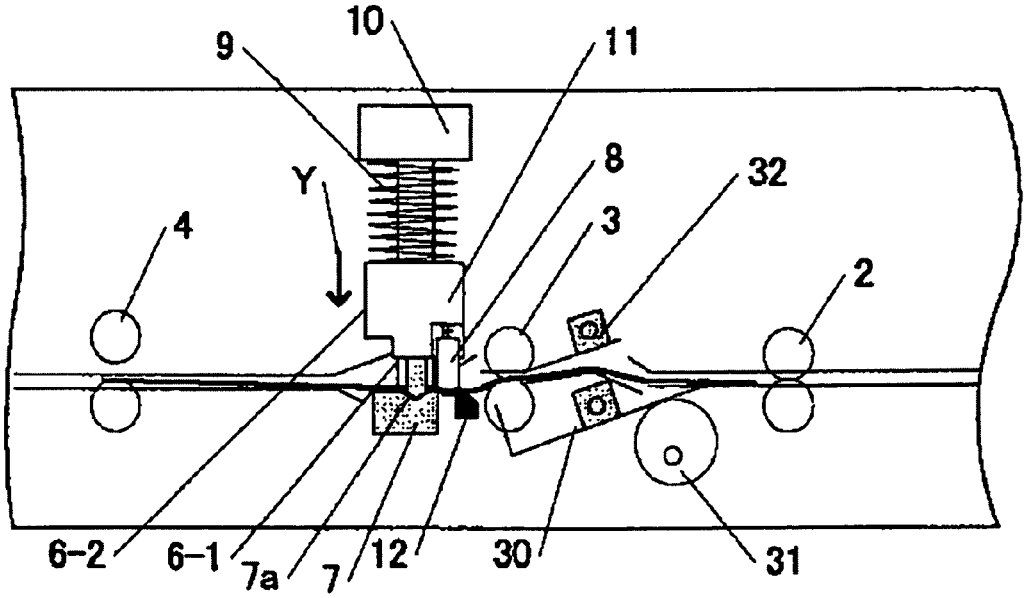
FIG. 19 is a schematic explanatory diagram of the creasing operations and illustrating a state in which the sheet stopped at the creasing position is being creased.
Figure 20:
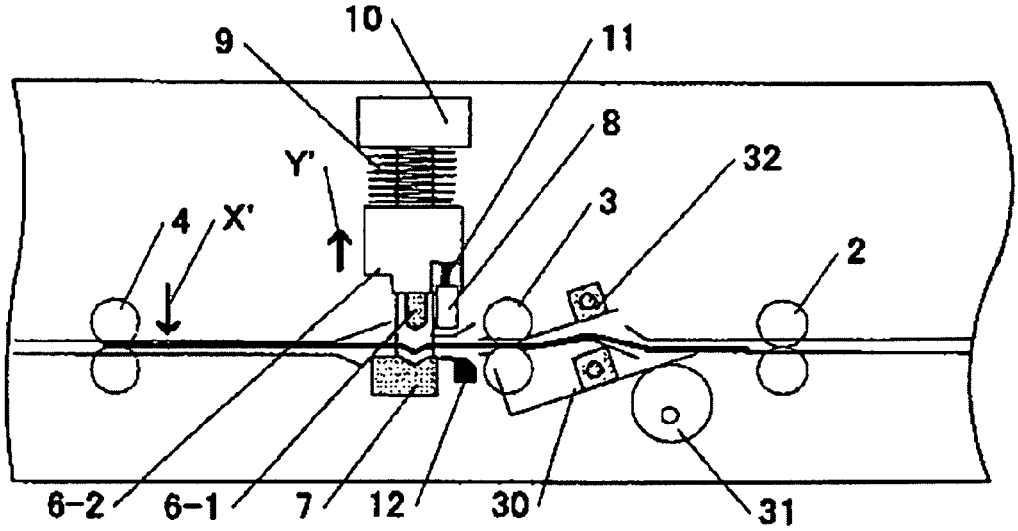
FIG. 20 is a schematic explanatory diagram of the creasing operations and illustrating a state in which, after the sheet has stopped at the creasing position, a creasing member is separated away from the sheet.
Figure 21:
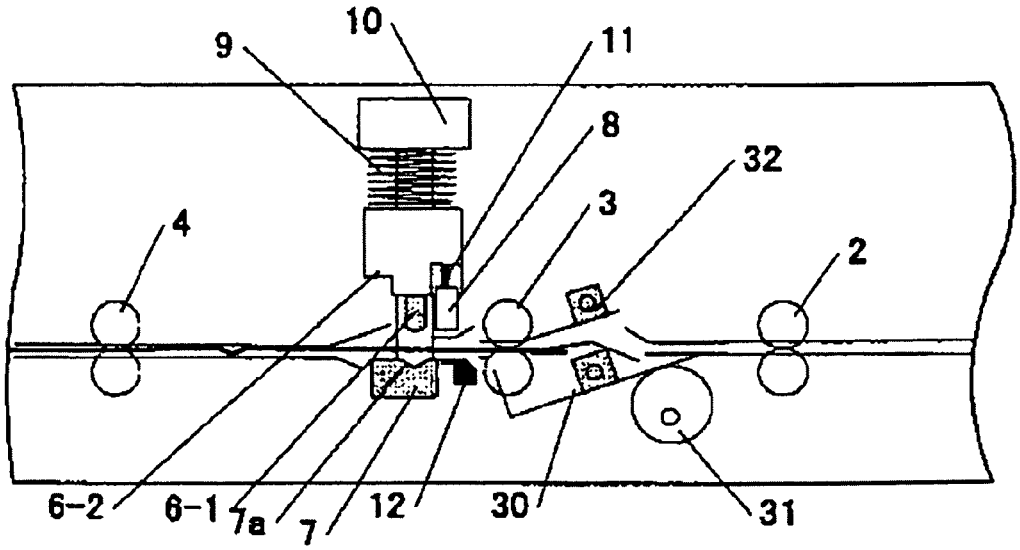
FIG. 21 is a schematic explanatory diagram of the creasing operations and illustrating a state in which the creasing member has been separated away from the sheet and sheet conveyance is started.

As illustrated in FIG. 19, after the fourth conveying rollers 4 have been released from the pressure contact, the creasing blade 6-1 further descends in the direction indicated by arrow Y to interpose the sheet P with the receiving member 7 at a predetermined pressure. As a result, a crease is formed on the sheet P. When the creasing process is completed, as illustrated in FIG. 20, the creasing blade 6-1 ascends in a direction indicated by arrow Y'. At timing when the creasing blade 6-1 is separated from the sheet P, the fourth conveying rollers 4 descend in a direction indicated by arrow X' to press against the sheet P again, thereby placing the sheet P in a conveyable state. Thereafter, as illustrated in FIG. 21, the sheet P is conveyed downstream by the fourth conveying rollers 4.

When the sheet P has been conveyed to the folding device B, the operations described above with reference to FIG. 10 to FIG. 13 or FIG. 14 and FIG. 15 are performed subsequently similarly to the situation described above in 2-1) where creasing is not performed.

Figure 22:
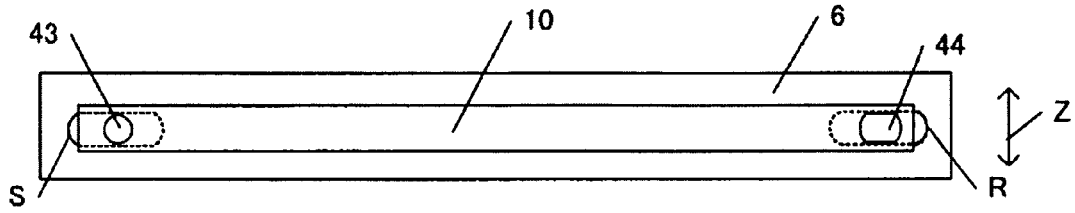
FIG. 22 is a plan view of a relevant portion of a configuration of a creasing unit according to a prior art.
Figure 23:
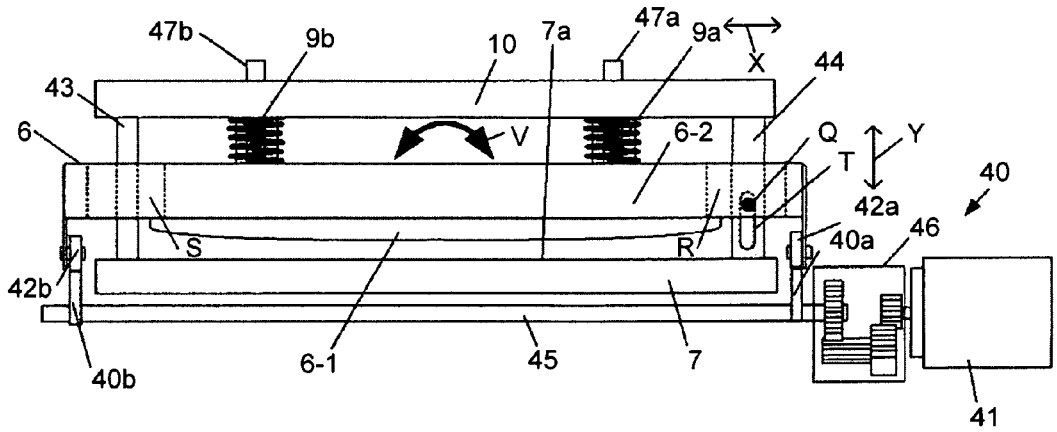
FIG. 23 is a front view of the relevant portion illustrated in FIG. 22.

FIG. 22 is a plan view illustrating a detailed configuration of a relevant portion of a creasing unit according to the prior art. FIG. 23 is a front view of the same (front view, as viewed from an upstream side in the sheet conveying direction, related to the plan view of FIG. 22). As illustrated in FIG. 22 and FIG. 23, the creasing unit includes a creasing member 6 (the creasing blade 6-1 and the creasing support member 6-2), the receiving member 7, and a drive mechanism 40.

The creasing member 6 has, in addition to the creasing blade 6-1 provided at a lower end of the creasing member 6, a first elongated hole R and a second elongated hole S, into which a first support shaft 44 and a second support shaft 43, which will be described later, are to be loosely fit, respectively, and includes a first positioning member 42*a* and a second positioning member 42*b* provided at a rear end portion and a front end portion, respectively. The first and second elongated holes R and S are elongated in a direction perpendicular to the sheet conveying direction and configured to allow the first support shaft 44 and the second support shaft 43 to oscillate relative to a plane that lies perpendicularly to the sheet conveying direction but not to allow movement in the sheet conveying direction. The first and second positioning members 42*a* and 42*b* extend substantially vertically downward from a rear end and a front end of the creasing support member 6-2, respectively. The first and second positioning members 42*a* and 42*b* are disciform cam followers that are rotatably supported at the centers and brought into contact, respectively, with a first cam 40*a* and a second cam 40*b* to be rotated. Meanwhile, the front side of the device is depicted on the left-hand side in FIG. 22 and FIG. 23.

The receiving member 7 is connected via the first and the second support shafts 44 and 43 to the spring fixing member 10 provided above the creasing member 6 and moved integrally with the spring fixing member 10.

In the spring fixing member 10, a first shaft member 47*a*, which is on a rear side of the spring fixing member 10, and a second shaft member 47*b*, which is on a front side, (collectively referred to as a "shaft member 47") are provided on two end portions of the creasing member 6 in a longitudinal direction. A first elastic member 9*a*, which is provided on the rear side, and a second elastic member 9*b*, which is provided on the front side, (collectively referred to as an "elastic member 9") are mounted on an outer periphery of the first shaft member 47*a* and an outer periphery of the second shaft member 47*b*, respectively, and constantly urging the spring fixing member 10 upward in a direction so that a pressing-force adjusting member C3 and the receiving member 7 are separated from each other. As illustrated in FIG. 22, the first support shaft 44 having a semicircular cross-sectional profile taken along short sides in a rectangular cross section is loosely fit in the first elongated hole R. A third vertically-elongated hole T is formed in the first support shaft 44 at a portion lower than a middle portion of the first support shaft 44. A rotating shaft Q is vertically inserted into the third elongated hole T from a side of a side surface of the creasing member 6 (in a direction perpendicular to the plane of FIG. 23). The diameter of the rotating shaft Q is set to such a dimension, relative to the width of the third elongated hole T, that allows the rotating shaft Q to move in Y directions in FIG. 23 but prevents the same from moving in X directions. This allows the first support shaft 44 to rotate about the rotating shaft Q and move in the longitudinal direction of the third elongated hole T. The configurations described above allow an oscillating motion as indicated by arrow V in FIG. 23.

The drive mechanism 40 is a mechanism that rotates the cams 40*a* and 40*b*, which are in contact with the positioning members 42*a* and 42*b*, respectively, to press the creasing member 6 against the receiving member 7 and move the creasing member 6 away from the receiving member 7. The drive mechanism 40 includes a camshaft 45, to which the first cam 40*a* and the second cam 40*b* are coaxially connected at a rear portion and a front portion of the camshaft 45, respectively, a drive gear train 46, through which the camshaft 45 is driven, at an end portion (in the embodiment, a rear end portion) of the camshaft 45, and a drive motor 41 that drives the drive gear train 46. The first cam 40*a* and the second cam 40*b* are provided to face the first positioning member 42*a* and the second positioning member 42*b* and abutting thereon, respectively. The cams 40*a* and 40*b* move the creasing member 6 toward and away from the receiving member 7 according to a distance between the positioning members 42*a* and 42*b* on a straight line passing through a center of the camshaft 45 and a center of rotation of the positioning members 42*a* and 42*b*. At this time, a range where the creasing member 6 moves is restricted by each of the first and the second support shafts 44 and 43 and the first and the second elongated grooves R and S. The creasing member 6 reciprocates under this restricted state. A configuration is employed to cause the creasing blade 6-1 of the creasing member 6 to come into contact with the receiving member 7 in an orientation tilted relative to the receiving member 7 rather than parallel to the receiving member 7 so that the creasing blade 6-1 oriented obliquely relative to a plane of the sheet produces a crease on the sheet according to shapes of the first and the second cams 40*a* and 40*b*. The creasing blade 6-1 has a circular-arc edge as illustrated in FIG. 23.

FIG. 24 to FIG. 36 are schematic illustrations of operations performed to crease (making a folding mark) a sheet by using the creasing member 6. Creasing operations start when the drive motor 41 starts running in response to a designation input from the CPU_A1, which will be described later, illustrated in FIG. 41.

Figure 24:
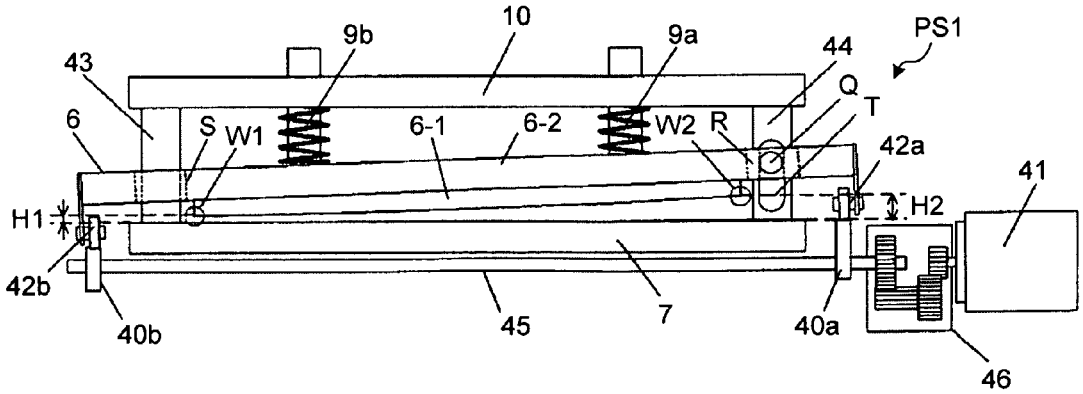
FIG. 24 is a schematic explanatory diagram of a creasing operations using the creasing unit according to the prior art and illustrating an initial state in which the creasing member is provided at an uppermost position.

FIG. 24 illustrates a first standby position PS1 of the creasing member 6 before the operations start. When the creasing member 6 is at the first standby position PS1, the creasing blade 6-1 is on standby with one end W1 of the creasing blade 6-1 on the left in FIG. 24 (in the embodiment, a front end) at a distance H1 from a top surface of the receiving member 7 and other end W2 on the right in FIG. 24 (in the embodiment, a rear end) at a distance H2 from the top surface of the receiving member 7. The positional relationship between H1 and H2 is expressed as follows.

$$H1<H2$$

Figure 25:
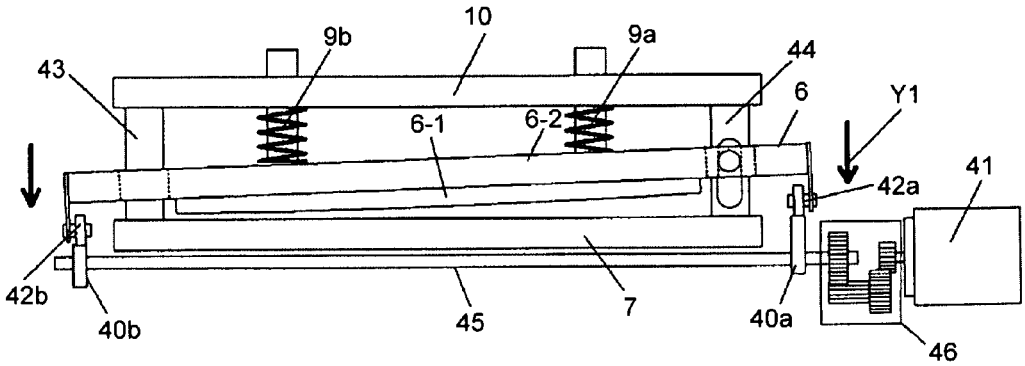
FIG. 25 is a schematic explanatory diagram of the creasing operations using the creasing unit according to the prior art and illustrating a state in which a creasing is abutting on a creasing groove.
Figure 26:
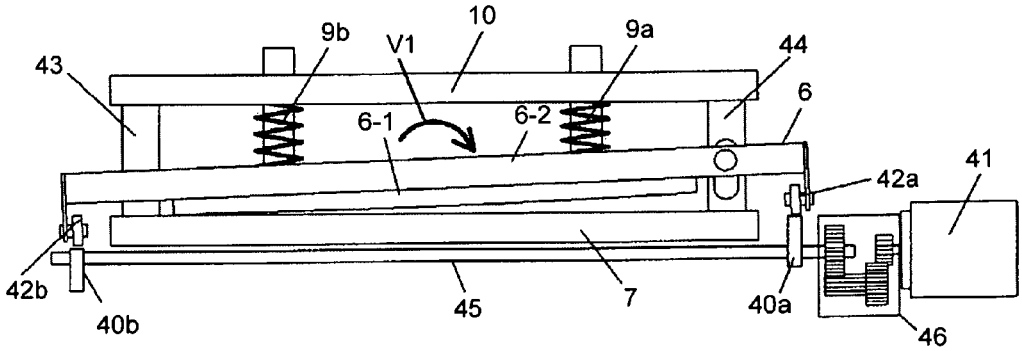
FIG. 26 is a schematic explanatory diagram of the creasing operations using the creasing unit according to the prior art and illustrating a state in which the creasing blade is abutting on the creasing groove to form a crease.

From this state in which the creasing member 6 is at the first standby position PS1, the drive motor 41 is run to rotate the camshaft 45, the first cam 40*a*, and the second cam 40*b*, causing the creasing member 6 to move in a direction indicated by arrow Y1 as illustrated in FIG. 25. As the creasing member 6 is moved in this manner, the one end W1 of the creasing blade 6-1 abuts on the creasing groove 7*a* of the receiving member 7 as illustrated in FIG. 26, and the second positioning member 42*b* and the second cam 40*b* are separated from each other. At this time, the edge of the creasing blade 6-1 on the side of the other end W2 is not in contact with the creasing groove 7*a*, and contact between the first positioning member 42*a* and the first cam 40*a* is still maintained.

When the camshaft 45, and the first and second cams 40*a* and 40*b* are further rotated from this state, the first positioning member 42*a* is moved in the Y1 direction. Accordingly, as illustrated in FIG. 26 and FIG. 27, the creasing blade 6-1 makes sliding contact with the creasing groove 7*a* of the receiving member 7 therealong while rotating in a direction indicated by arrow V1, thereby forming a crease to a center of the sheet with the pressing force exerted by the first and second elastic members (compression springs) 9*a* and 9*b*.

Figure 27:
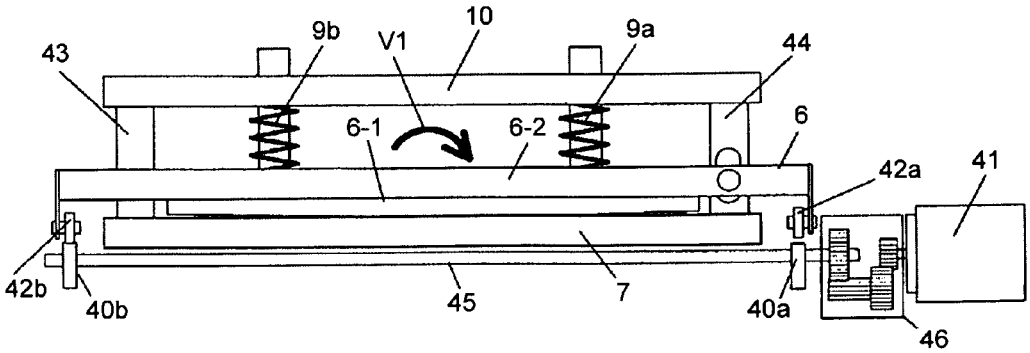
FIG. 27 is a schematic explanatory diagram of the creasing operations using the creasing unit according to the prior art and illustrating a state in which an abutting position, at which the creasing blade abuts on the creasing groove, is moved toward a front side of the folding device and a portion of the creasing blade having been in contact with the sheet is separated therefrom.
Figure 28:
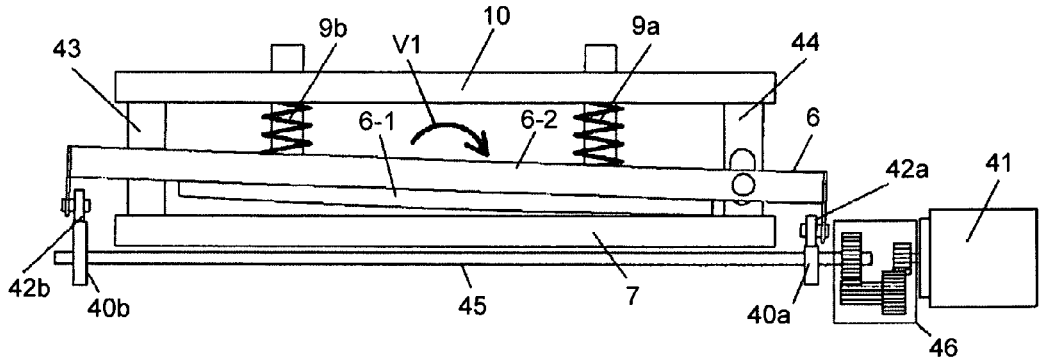
FIG. 28 is a schematic explanatory diagram of the creasing operations using the creasing unit according to the prior art and illustrating a state in which the creasing blade is separated from a receiving member.

As illustrated in FIG. 27, when a contact point between the creasing blade 6-1 and the creasing groove 7*a* has reached the center of the sheet, the second positioning member 42*b* and the second cam 40*b* are in contact with each other, whereas the first positioning member 42*a* and the first cam 40*a* are separated from each other. When the camshaft 45, and the first and second cams 40*a* and 40*b* are further rotated, as illustrated in FIG. 28, the creasing blade 6-1 further rotates in the V1 direction to make sliding contact with the creasing groove 7*a* of the receiving member 7 therealong from the position illustrated in FIG. 27, thereby forming the crease extending to an end of the sheet, on the rear side, with the pressing force exerted by the first and second elastic members 9*a* and 9*b*.

Figure 29:
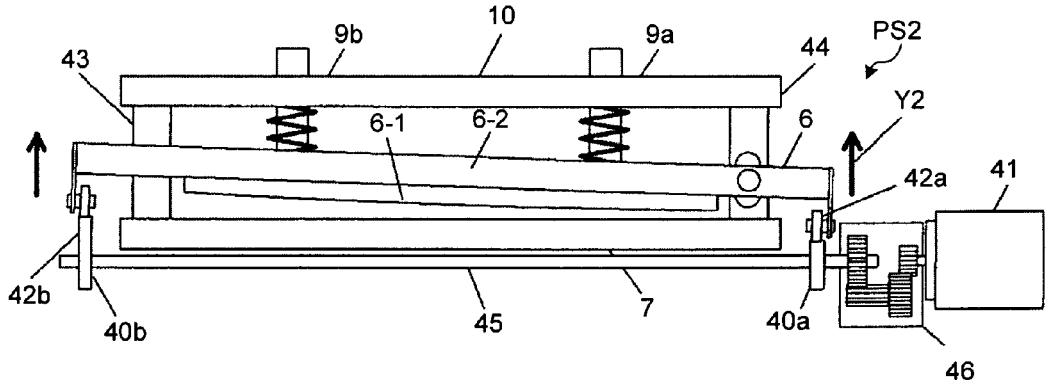
FIG. 29 is a schematic explanatory diagram of the creasing operations using the creasing unit according to the prior art and illustrating a state in which the creasing blade swings reversely, after being separated from the receiving member, and returns to an initial state.

When the contact point between the creasing blade 6-1 and the creasing groove 7*a* has reached an end of the receiving member 7 on the rear side, the first positioning member 42*a* and the first cam 40*a* are also brought into contact with each other, and the creasing member 6 ascends in a direction indicated by arrow Y2 as illustrated in FIG. 29, while the creasing blade 6-1 is separated from the creasing groove 7*a* of the receiving member 7. Thereafter, after the creasing member 6 has ascended for a moment, the drive motor 41 is stopped, causing the creasing member 6 to stop at a second standby position PS2 illustrated in FIG. 30. At this time, the creasing member 6 is stopped with the one end W1 of the creasing member 6 at a distance H3 from the top surface of the receiving member 7 and the other end W2 at a distance H4 from the receiving member 7. The positional relationship between H3 and H4 is expressed as follows.

$$H4<H3$$

Relationships among the distances H1 to H4 at the first standby position PS1 and the second standby position PS2 can be expressed as follows.

$$H1=H4$$

$$H2=H3$$

An abutting position where the creasing blade 6-1 abuts on the creasing groove 7*a* of the receiving member 7 is out of a range in which sheets are conveyed; accordingly, after the creasing blade 6-1 has abutted on the creasing groove 7*a*, a sheet is interposed between the creasing blade 6-1 and the creasing groove 7*a* as the abutting position changes.

Figure 30:
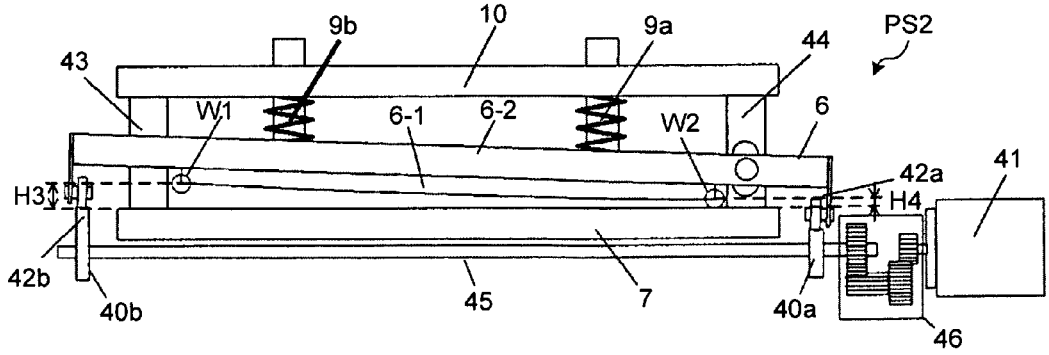
FIG. 30 is a schematic explanatory diagram of the creasing operations using the creasing unit according to the prior art and illustrating an initial position for forming a crease on a next sheet from an opposite side.
Figure 31:
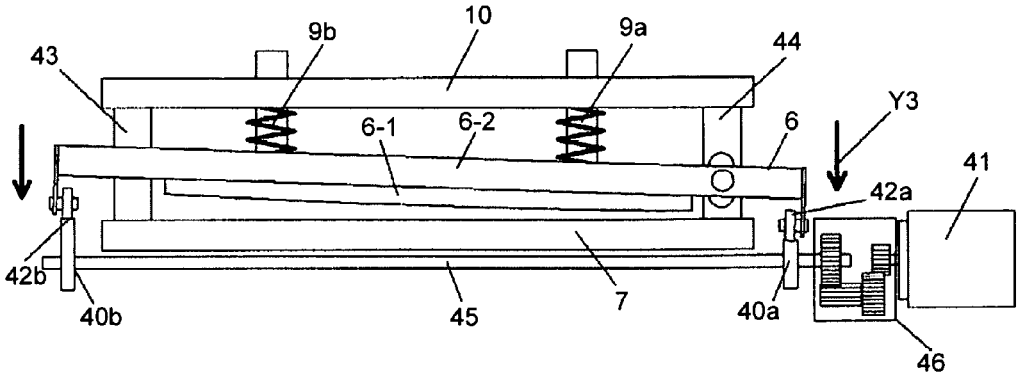
FIG. 31 is a schematic explanatory diagram of the creasing operations using the creasing unit according to the prior art and illustrating a state in which the creasing blade has abutted on the creasing when the next sheet is to be creased.
Figure 32:
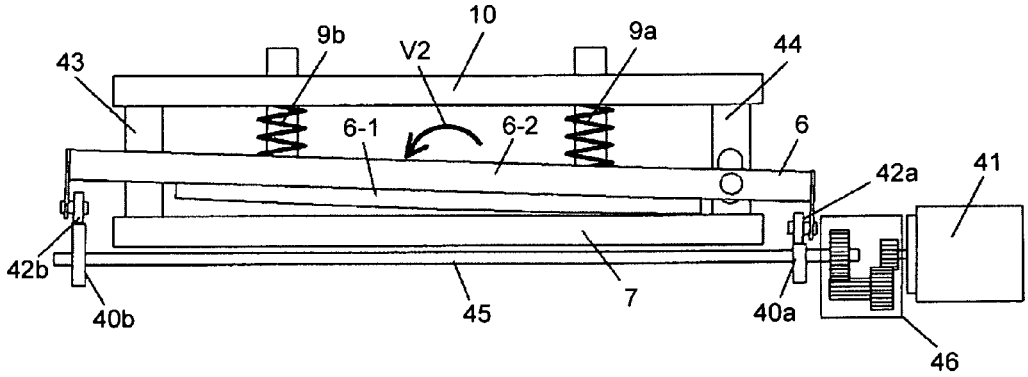
FIG. 32 is a schematic explanatory diagram of the creasing operations using the creasing unit according to the prior art and illustrating a state in which the creasing blade is abutting on the creasing when the next sheet is to be creased and creasing the next sheet.
Figure 33:
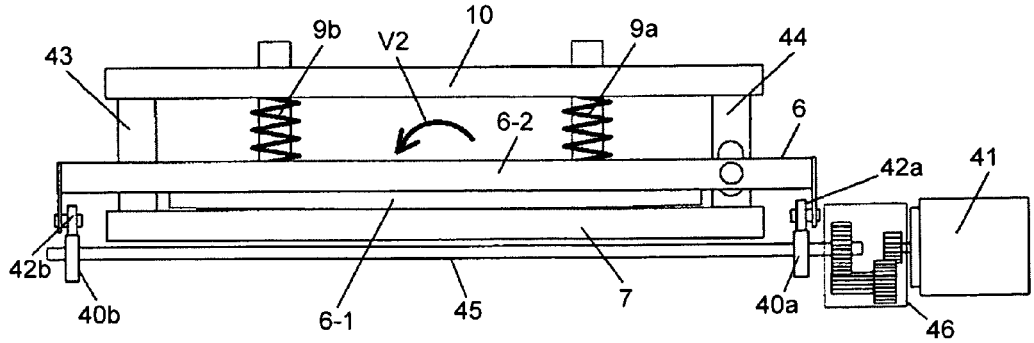
FIG. 33 is a schematic explanatory diagram of the creasing operations using the creasing unit according to the prior art and illustrating a state in which a portion of the creasing blade that is abutting on the creasing groove is moved toward the front side of the folding device when the next sheet is to be creased and another portion of the creasing blade that has been in contact with the sheet is separated therefrom.
Figure 34:
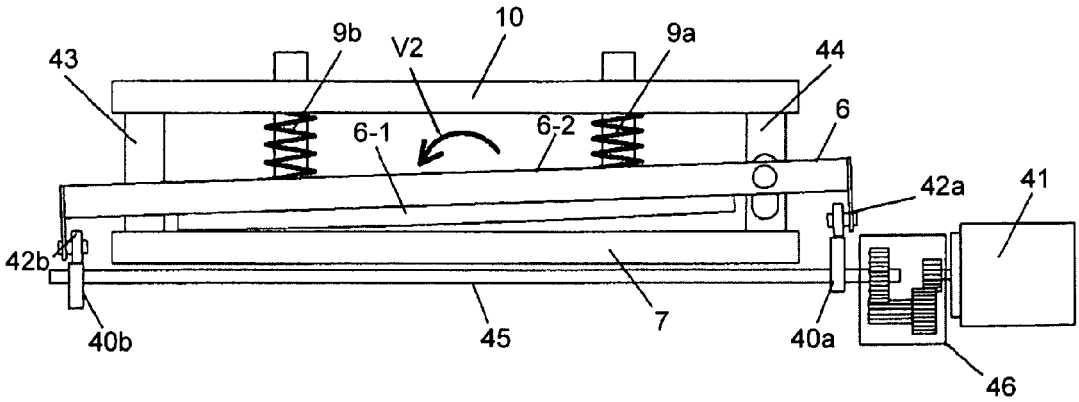
FIG. 34 is a schematic explanatory diagram of the creasing operations using the creasing unit according to the prior art and illustrating a state in which the creasing blade is separated from the receiving member when the next sheet is to be creased.
Figure 35:
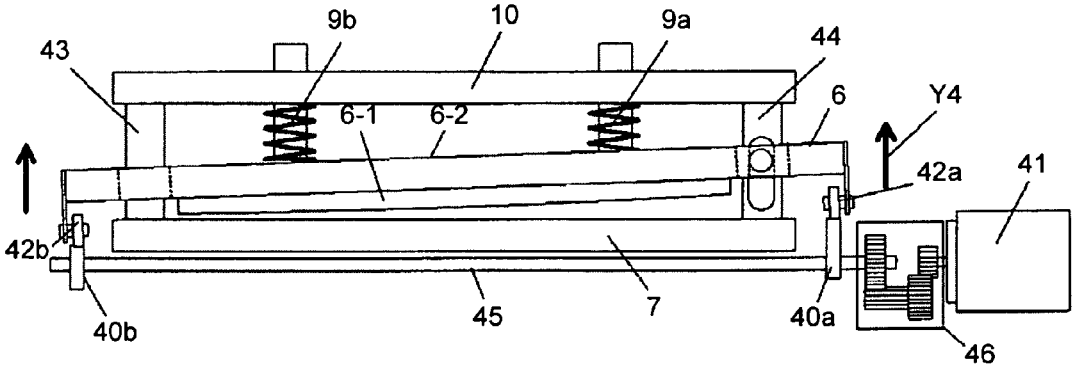
FIG. 35 is a schematic explanatory diagram of the creasing operations using the creasing unit according to the prior art and illustrating a state in which the creasing blade is separated from the receiving member when the next sheet is to be creased, swings reversely, and returns to the initial state.
Figure 36:
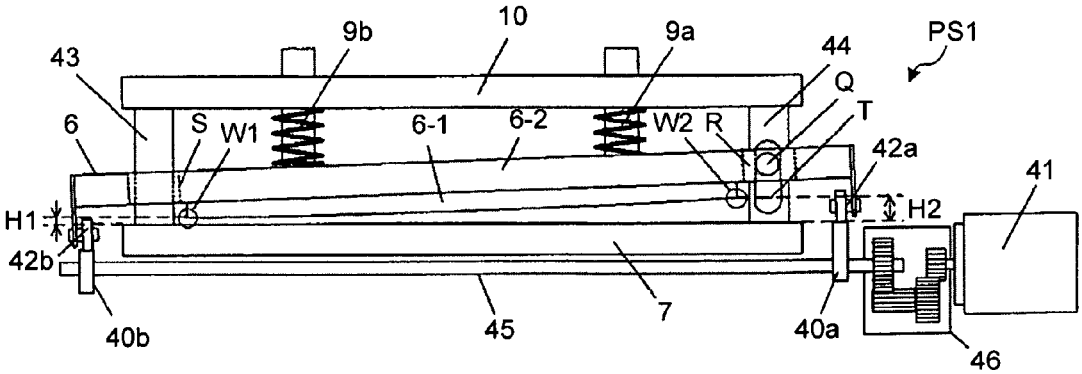
FIG. 36 is a schematic explanatory diagram of the creasing operations using the creasing unit according to the prior art and illustrating a state in which the creasing member has returned to the initial position illustrated in FIG. 24 when a sheet subsequent to the next sheet is to be creased.

When a next sheet is to be creased, as illustrated in FIG. 31 to FIG. 36, the creasing member 6 is moved down in FIG. 31 from the state illustrated in FIG. 30 such that the other end W2, which is provided on the rear end side, descends first to interpose the sheet with the receiving member 7 and performs the creasing operations. That is, the creasing member 6 performs the operations of FIG. 29 to FIG. 24 in the reversed order, and stops at the first standby position PS1 in FIG. 36. More specifically, the creasing member 6 returns to the position where the one end W1 of the creasing blade 6-1 is at the distance H1 from the top surface of the receiving member 7 and the other end W2 is at the distance H2 from the top surface of the receiving member 7 and stops at the position to wait for creasing operations of the next sheet.

By repeatedly performing the set of operations on a per-sheet basis, a predetermined number of sheets can be creased.

As described above, in the creasing unit according to the prior art, the first and second elastic members 9*a* and 9*b* that are fixed at upper ends to the spring fixing member 10 elastically urge the creasing member 6. The spring fixing member 10 is fixed to the receiving member 7, and it has been incapable of adjusting the elastic forces exerted by the first and second elastic members 9*a* and 9*b*. Accordingly, it has been incapable of adjusting a pressing force necessarily to be adjusted to a sheet type, a sheet size, and/or thickness of a sheet to be creased, of the sheet as described above.

Figure 37:
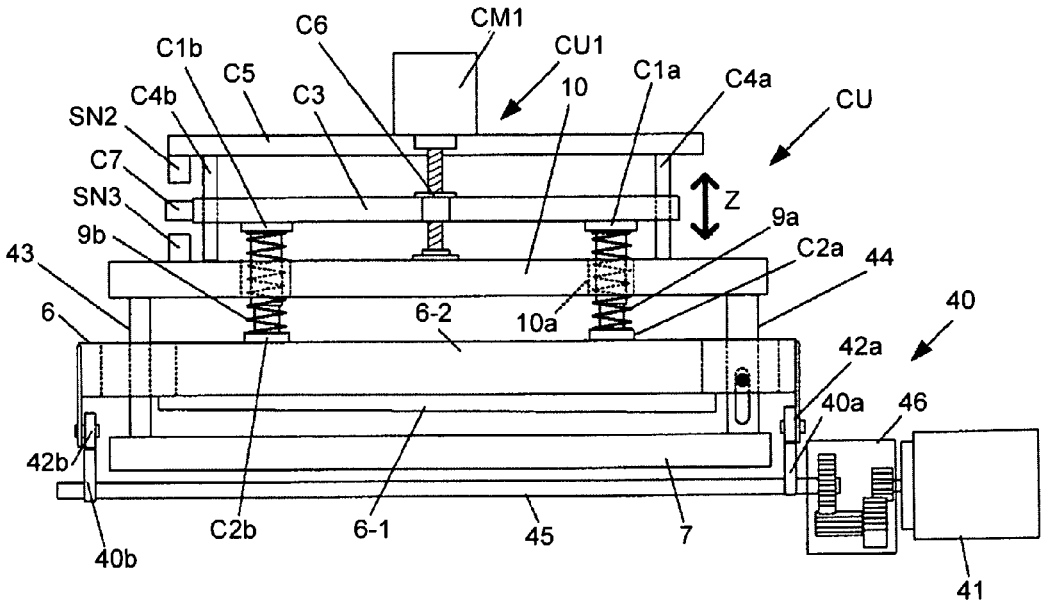
FIG. 37 is a front view illustrating a configuration of the creasing unit capable of adjusting a pressing force for creasing according to an embodiment as viewed from an upstream side in a sheet conveying direction.

FIG. 37 is a front view, viewed from the upstream side in the sheet conveying direction, illustrating the configuration of a creasing unit C capable of adjusting the pressing force for creasing (i.e., the elastic force of the first and second elastic members 9*a* and 9*b* are made to be adjustable) according to the embodiment. The creasing unit C according to the embodiment differs from the creasing unit illustrated in FIG. 23 in additionally including the pressing-force adjusting mechanism CU. More specifically, the creasing unit C according to the embodiment includes the creasing member 6. (the creasing blade 6-1 and the creasing support member 6-2), the receiving member 7, the drive mechanism 40, and the pressing-force adjusting mechanism CU. The pressing-force adjusting mechanism CU is mounted on a top of the spring fixing member 10 illustrated in FIG. 23.

The pressing-force adjusting mechanism CU includes a linear motion unit CU1, an upper-limit detecting sensor SN2, a lower-limit detecting sensor SN3, and a sensor feeler C7. The linear motion unit CU1 includes the first and second elastic members 9*a* and 9*b*, a first spring guide C1*a* and a second spring guide C1*b*, spring washers C2*a* and C2*b*, the pressing-force adjusting plate C3, guide shafts C4*a* and C4*b*, an adjusting-mechanism fixing plate C5, a ball screw C6, and a stepping motor CM1.

The adjusting-mechanism fixing plate C5 is provided at a top portion. The stepping motor CM1 is fixed to a center portion of the adjusting-mechanism fixing plate C5. The first guide shaft C4*a* and the second guide shaft C4*b* are provided at a rear portion of the device and a front portion of the device, respectively, of the adjusting-mechanism fixing plate C5. Upper ends of the guide shafts C4*a* and C4*b* are fixed to the adjusting-mechanism fixing plate C5 and lower ends of the same are fixed to the spring fixing member 10, thereby connecting the adjusting-mechanism fixing plate C5 to the spring fixing member 10.

The ball screw C6 is coaxially attached to a drive shaft of the stepping motor CM1. A lower end of the ball screw C6 is fixed to the spring fixing member 10 as are the first and second guide shafts C4*a* and C4*b*. The pressing-force adjusting plate C3 is assembled onto the ball screw C6. The first and second guide shafts C4*a* and C4*b* are inserted through (loosely fit in) shaft insertion holes, which are formed on a front side and a rear side of the device, of the pressing-force adjusting plate C6. This allows the pressing-force adjusting plate C3 to move in directions indicated by arrow Z in FIG. 37.

The first and second spring guides C1*a* and C1*b* are fixed to the pressing-force adjusting plate C3. The first and second spring washers C2*a* and C2*b* are fixed to the creasing member 6. The first elastic member 9*a* is mounted between the first spring guide C1*a* and the first spring washer C2*a* through a through hole formed in the spring fixing member 10, while the second elastic member 9*b* is mounted between the second spring guide C1*b* and the second spring washer C2*b* through a through hole formed in the spring fixing member 10. The first and second elastic members 9*a* and 9*b* exert a pressing force on the creasing member toward the receiving member 7.

Thus, the spring fixing member 10 is connected at a top portion to the adjusting-mechanism fixing plate C5 via the first and second guide shafts C4*a* and C4*b* and connected at a bottom portion to the receiving member 7 via the first and the second support shafts 44 and 43. The pressing-force adjusting plate C3 and the creasing member 6 are provided above the spring fixing member 10 and below the same, respectively, with the first and second elastic members 9*a* and 9*b* interposed therebetween. The sensor feeler C7 is provided at an end portion of the pressing-force adjusting plate C3 on the front side of the device. The upper-limit detecting sensor SN2 is provided on the adjusting-mechanism fixing plate C5 at a position on a line extending in the Z direction through the sensor feeler C7 that is at the end portion on the front side of the device, while the lower-limit detecting sensor SN3 is provided on the spring fixing member 10 at a position on a line extending through the sensor feeler in the Z direction. By controlling driving of the stepping motor CM1 in response to outputs from the detecting sensors SN2 and SN3, a moving range of the pressing-force adjusting plate C3 in the Z direction is restricted.

Figure 38:
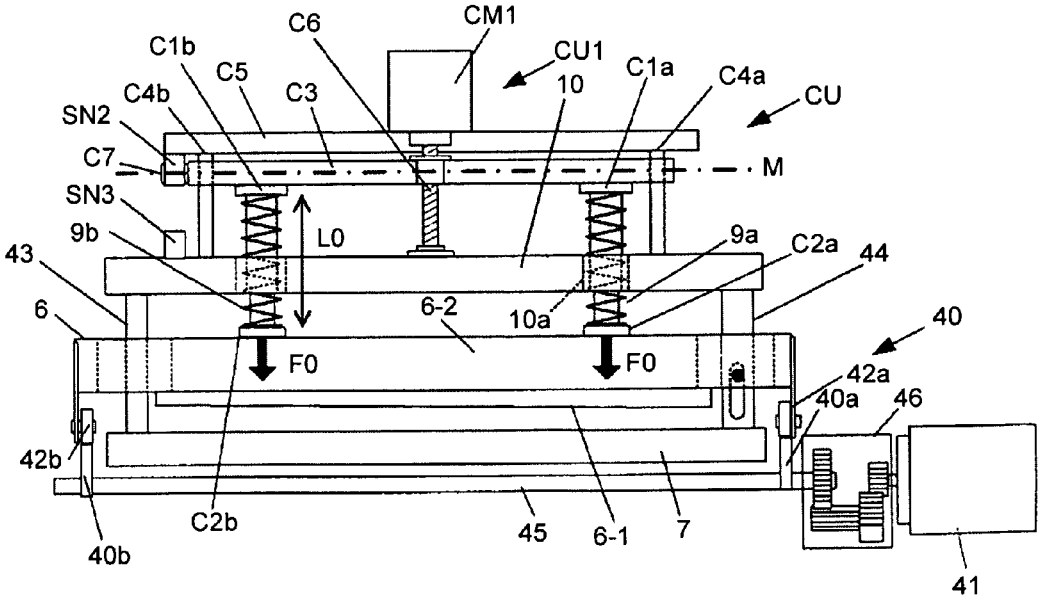
FIG. 38 is a diagram illustrating the creasing unit illustrated in FIG. 37 being on a standby state prior to adjusting the pressing force.

FIG. 38 is a diagram illustrating a standby state prior to pressing-force adjustment. At a standby position M, the pressing-force adjusting plate C3 is in a standby state in which a length L of the first and second elastic members 9*a* and 9*b* becomes a natural length L0. At the standby position M, the sensor feeler C7 is at an upper-limit position, and hence the upper-limit detecting sensor SN2 is in a detecting state. At this time, a pressing force F0 exerted by the first and second elastic members 9*a* and 9*b* on the creasing member 6 is 0 Newton (N). By putting the pressing-force adjusting plate C3 on standby at the standby position M except when creasing is performed, application of excessive load on parts of the creasing unit C and the pressing-force adjusting mechanism CU by the springs (elastic members) is prevented. This leads to increase in durability of the parts in each unit.

Figure 39:
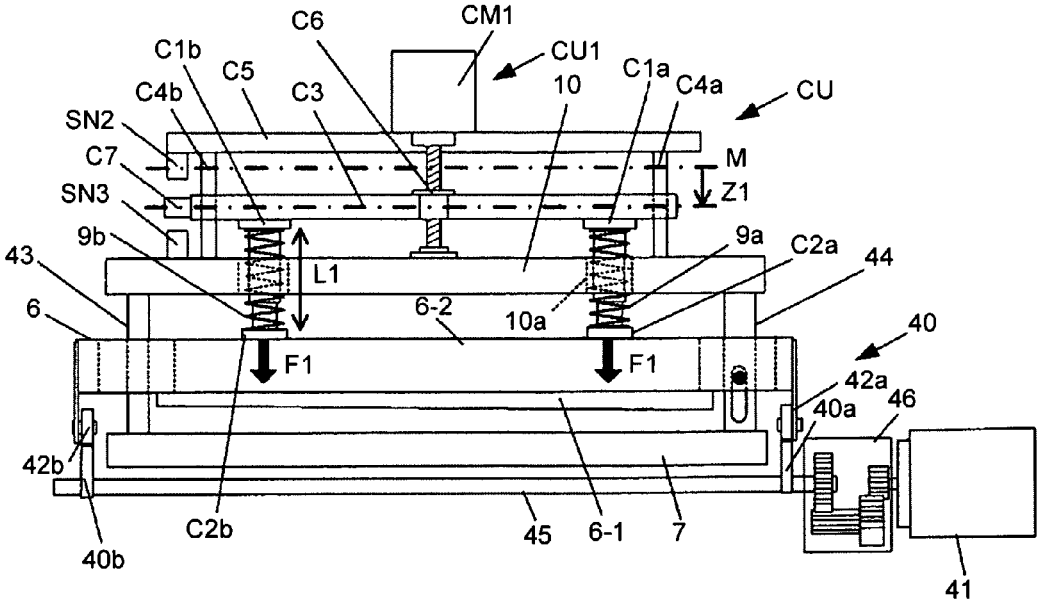
FIG. 39 is a schematic explanatory diagram of an operation to change the pressing force of the creasing unit illustrated in FIG. 37.
Figure 41:
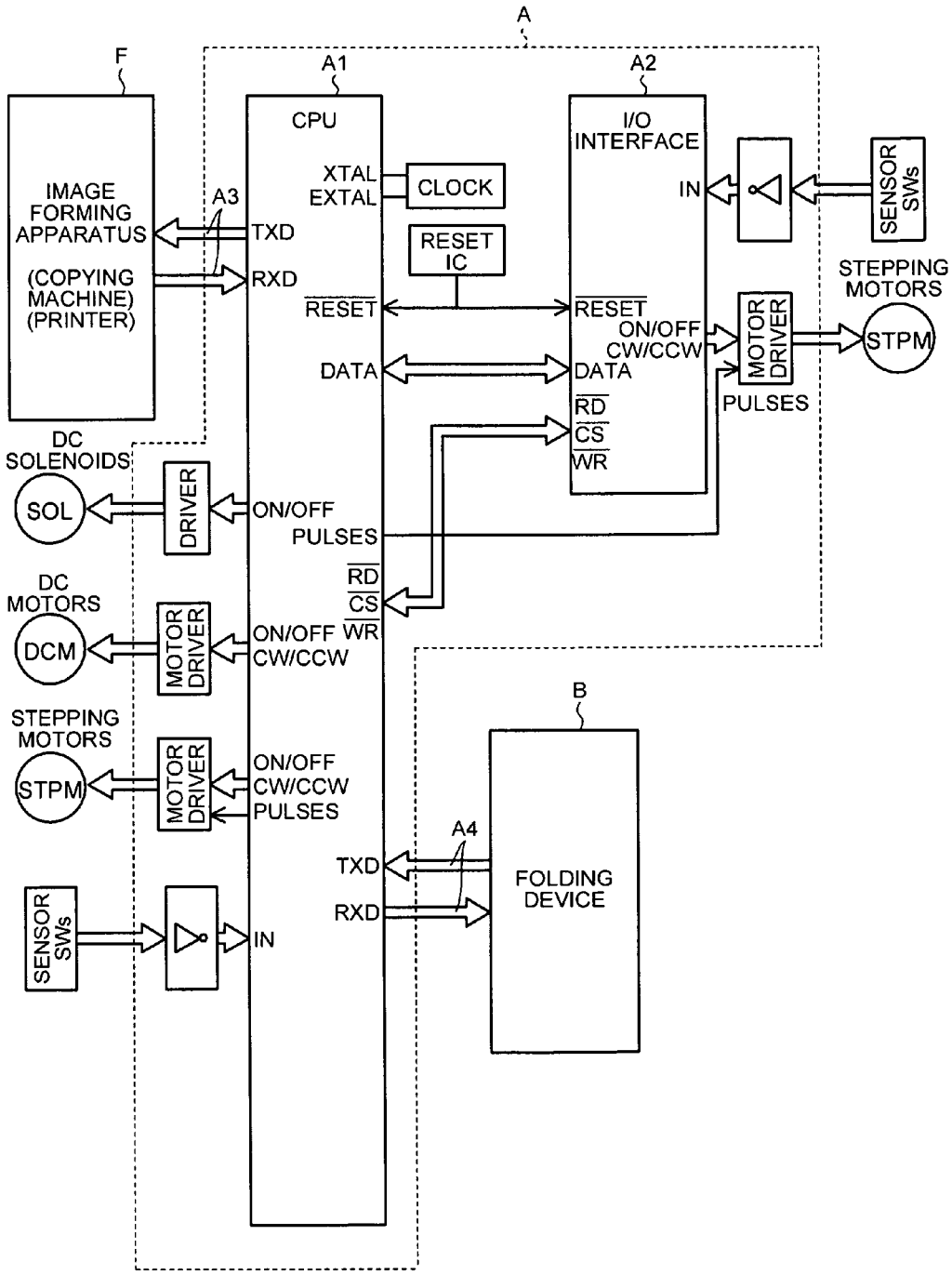
FIG. 41 is a block diagram illustrating a control structure of the image forming system including a creasing device, a folding device B, and an image forming apparatus F.

FIG. 39 is a schematic explanatory diagram of pressing-force changing operations. When the stepping motor CM1 is rotated from the state illustrated in FIG. 38, the ball screw C6 descends straight along the first and second guide shafts C4*a* and C4*b* to travel downward a specified distance Z1 from the standby position M. The specified distance Z1 is set based on sheet information (information about a sheet type, a sheet size, sheet thickness, and number of sheets in a sheet bundle) acquired from the image forming apparatus F. More specifically, an optimum pressing force F1 is determined by referring to conditions for a pressing force and information acquired from the image forming apparatus F. The conditions for the pressing force correspond to sheet information having been input in advance from a CPU of a control circuit board connected to the creasing device C, as illustrated in FIG. 41, and stored in a memory (storage section) (not shown) mounted on the control circuit board. Thereafter, the moving distance Z1 needed to output the optimum pressing force F1 is calculated by using a spring constant k of the first and second elastic members 9*a* and 9*b*. Meanwhile, the conditions for the pressing-force corresponding to the sheet information having been input in advance have been obtained in advance through experiment and stored in the memory in the form of a table.

Figure 40:
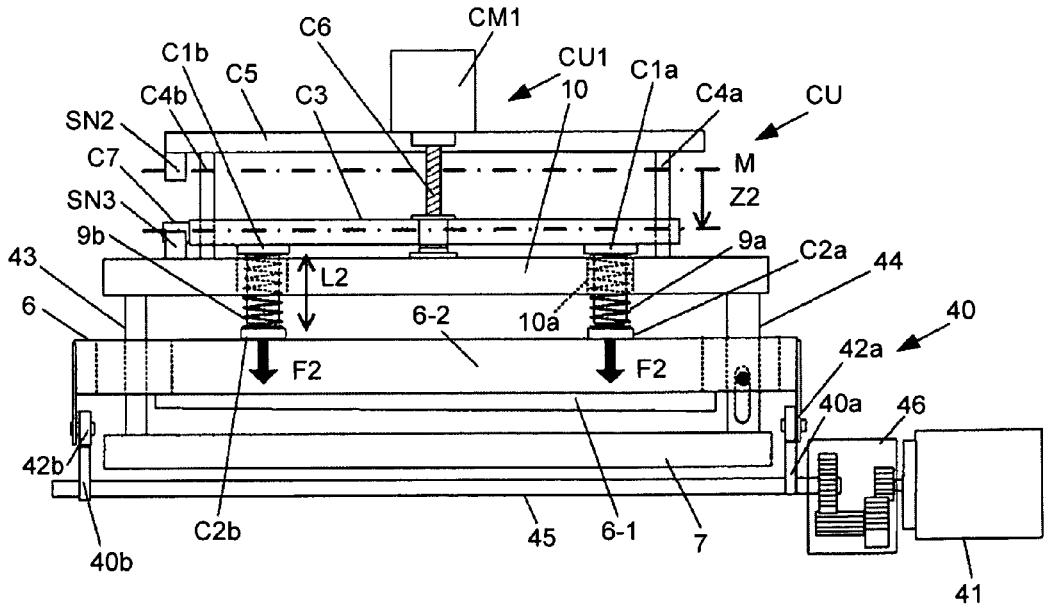
FIG. 40 is a diagram illustrating a state in which a pressing-force adjusting plate of the creasing unit illustrated in FIG. 37 is at a lowermost position.

FIG. 40 is a diagram illustrating a state in which the pressing-force adjusting plate C3 is at a lower-limit position. The lower-limit detecting sensor SN3 is provided at a position where the pressing-force adjusting plate C3 reaches when the pressing-force adjusting plate C3 has traveled a distance Z2 from the standby position M. The sensor feeler C7 blocks an optical path of the lower-limit detecting sensor SN3, causing the lower-limit position of the pressing-force adjusting plate C3 to be detected. When a bending amount needed to generate a pressing force Fmax, which is a greatest pressing force among pressing forces of the conditions for sheets, is denoted by δmax (=Fmax/k), and a permissible bending amount of the first and second elastic members 9*a* and 9*b* is denoted by δlim, a mounting height (the distance Z2) of the lower-limit detecting sensor SN3 is desirably set in a range expressed by the following inequalities.

$$\delta lim \geqq Z2 > \delta max$$

By satisfying the above inequalities, a crease can be formed without causing permanent distortion in the first and second elastic members 9*a* and 9*b*.

When the creasing operations are completed or when an anomaly occurs during the creasing, operations to release the pressing force are performed. More specifically, the stepping motor CM1 is rotated in a reverse direction to the direction in which the stepping motor CM1 rotates during pressing, thereby elevating the pressing-force adjusting plate C3 until the upper-limit detecting sensor SN2 detects the sensor feeler C7 and enters a detecting state. After the upper-limit detecting sensor SN2 has detected the sensor feeler C7, the stepping motor CM1 is stopped, putting the pressing-force adjusting plate C3 on standby at the standby position M illustrated in FIG. 38.

FIG. 41 is a block diagram illustrating a control structure of the image forming system including the creasing device A, the folding device B that performs folding, and the image forming apparatus F. The creasing device A includes a control circuit equipped with a microcomputer including a central processing unit (CPU) CPU_A1 and an input/output (I/O) interface A2. Various signals are input to the CPU_A1 via a communications interface A3 from a CPU, various switches on a control panel, and various sensors (not shown) of the image forming apparatus F. The CPU_A1 performs predetermined control operations based on the input signal. The CPU_A1 receives signals similar to those mentioned above from the folding device B via a communications interface A4 and performs predetermined control operations based on the input signal. The CPU_A1 also performs drive control for solenoids and motors via drivers and motor drivers and obtains detection information from sensors in the device via the interface. The CPU_A1 also performs drive control for motors via the I/O interface A2 and via motor drivers according to an entity to be controlled and sensors and obtains detection information from sensors. The CPU_A1 performs the control operations described above by reading program codes stored in a read only memory (ROM) (not shown), storing the program codes into a random access memory (RAM) (not shown), and executing program instructions defined in the program codes by using the RAM as a working area and data buffer.

The creasing device A illustrated in FIG. 41 is controlled according to an instruction or information input from the CPU of the image forming apparatus F. An operating instruction is input by a user from a control panel (not shown) of the image forming apparatus F. Accordingly, an operation signal input from the control panel is transmitted from the image forming apparatus F to the creasing device A and to the folding device B. Operation status and functions of the devices A and B are notified to a user through the control panel.

FIG. 42 is a flowchart illustrating a process procedure for pressing-force control and the creasing according to the embodiment. The process procedure is to be performed by the CPU_A1 of the creasing device A.

In FIG. 42, it is first determined whether to perform the creasing (Step S101). This determination is made based on whether designation for creasing has been input from a side of the image forming apparatus F. If the creasing is to be performed (YES at Step S101), sheet information, or, more specifically, information about a sheet size, sheet thickness, a sheet type such as special paper (paper, on which a process different from that for normal paper is to be performed), or the number of sheets of a sheet bundle, is acquired from the side of the image forming apparatus F (Step S102). By referring to conditions for pressing forces corresponding to the sheet information having been input and stored in the memory in advance as described above and the sheet information acquired from the image forming apparatus F (Step S103), the optimum pressing force F1 is determined (Step S104). A pressing force is changed from a present state according to the determination of the pressing force F1 (Step S105). More specifically, by using the spring constant k of the first and second elastic members 9*a* and 9*b*, the moving distance Z1 needed to output the optimum pressing force F1 is calculated. Driving of the stepping motor CM1 is controlled according to the moving distance Z1, thereby moving the pressing-force adjusting plate C3 downward. Subsequently, it is determined whether the lower-limit detecting sensor SN3 is detecting the sensor feeler C7 (Step S106). If detection by the lower-limit detecting sensor SN3 has not occurred, it is determined whether the device is ready for receiving a sheet (Step S107). If the device is ready for receiving the sheet, sheet conveyance is started immediately, while if the device is not ready for receiving the sheet, sheet conveyance is started when the device becomes ready for receiving the sheet (Step S108).

While the sheet is conveyed in this way, the sheet is creased (Step S109). The creased sheet is conveyed to the folding device B (Step S110). At Step S110, processing from Step S102 is repeatedly performed until sheet conveyance to the folding device B for a job is completed (Step S111). With regard to processing to be repeated, at Step S114, it is determined whether the current sheet and a next sheet are identical to each other. If they are identical to each other, process control returns to Step S108. If they are not identical to each other, the process control returns to Step S102 to repeat processing.

Upon completion of the job, the pressing force is released (by rotating the stepping motor CM1 in the reverse direction to the direction in which the stepping motor CM1 is rotated during pressing) (Step S112). When the sensor feeler C7 is detected by the upper-limit detecting sensor SN2 (Step S113), the processing ends.

If the lower-limit detecting sensor SN3 detects the sensor feeler C7 at Step S106, the pressing-force adjusting plate C3 is moved up to release the pressing force (Step S115). When the upper-limit position of the pressing-force adjusting plate C3 is detected by the upper-limit detecting sensor SN2 (Step S116), notification of an error is transmitted to the side of the image forming apparatus F (Step S117) and driving of the image forming apparatus F is stopped (Step S118).

On the other hand, when the information received from the image forming apparatus F indicates that folding is to be performed without performing the creasing at Step S101, it is determined whether the upper-limit detecting sensor SN2 is detecting the sensor feeler C7 of the pressing-force adjusting plate C3 (Step S119). If the upper-limit detecting sensor SN2 detects that the sensor feeler C7 of the pressing-force adjusting plate C3 has reached the upper-limit position (YES at Step S119), it is determined whether the device is ready for receiving a sheet (Step S120). If the device is ready, or when the device has become ready, sheet conveyance is started (Step S121), and the sheet is conveyed to the folding device B (Step S122). Processing at Step S121 and Step S122 is repeatedly performed until the job is completed (Step S123).

If the upper-limit detecting sensor SN2 has not detected the sensor feeler C7 of the pressing-force adjusting plate C3 at Step S119, the pressing force is released (Step S124), and the process control waits for the pressing-force adjusting plate C3 to move up to the upper-limit position. When it is determined that the pressing-force adjusting plate C3 has reached the upper-limit position through the detection of the sensor feeler C7 by the upper-limit detecting sensor SN2 (Step S125), the process control proceeds to Step S120, and the processing at Step S120 and the following steps are performed.

Meanwhile, releasing the pressing force causes the pressing force to be set to zero or a minimum, initial pressing force. Accordingly, "releasing the pressing force" means that the optimum pressing force is set to zero or the minimum pressing force.

As described above, according to the embodiment, effects including the following effects can be yielded.

1) It is possible to change a pressing force, which is to be applied from the creasing blade 6-1, to an optimum pressing force according to sheet information on a sheet size, sheet thickness, or a sheet type, and to perform creasing with the optimum pressing force.
2) It is possible to reduce a driving load as the whole when compared with a driving load according to the prior art because the creasing is performed with the optimum pressing force that depends on the sheet type.
3) An unnecessarily large load is not applied to a sheet because the creasing is performed with the optimum pressing force that depends on the sheet type. Accordingly, quality of a crease to be formed by the creasing blade 6-1 is improved.
4) It is possible to reduce excessive load that is to be applied to parts by reducing the pressing force when the system is on standby or when the creasing is not performed. This can increase durability of the parts.
5) It is also possible to promote safety during repair and maintenance by reducing the pressing force in case of failure of the creasing unit C or the driving mechanism of the creasing blade.

In the embodiments, the reference symbol A denotes the creasing device; the creasing blade 6-1 corresponds to the convex blade; the creasing member 6 corresponds to the first member; the creasing groove 7*a* corresponds to the concave blade; the receiving member 7 corresponds to the second member; the drive mechanism 40 corresponds to the drive section; the CPU_A1 corresponds to the sheet-information-acquiring section; the pressing-force adjusting mechanism CU corresponds to the adjusting section; the CPU_A1 corresponds to the control section; memory corresponds to the storage section; the pressing-force adjusting plate C3 corresponds to the third member; the first elastic member 9*a* and the second elastic member 9*b* correspond to the elastic member; the stepping motor CM1 and the ball screw C6 correspond to the adjustment section; the reference symbol F denotes the image forming apparatus.

According to an aspect of the embodiment, a sheet serving as a target for creasing can be creased by minimizing a driving load involved in the creasing process.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A creasing device that forms a crease on a sheet, the creasing device comprising:

a first member, extending in a direction perpendicular to a sheet conveying direction, on which a convex blade having a convex cross section is formed;

a second member, provided at a position to face the first member, on which a groove-like concave blade is formed such that the convex blade can be fitted into the concave blade by interposing the sheet therebetween;

a drive unit that causes the first member and the second member to be relatively in contact with and separated from each other so as to interpose, therebetween, the sheet that has been stopped at a predetermined position and to form a crease on the sheet;

a sheet-information acquiring unit that acquires first sheet information of the sheet to be creased;

a first adjusting unit that adjusts a pressing force exerted by the drive unit; and a control unit that sets the pressing force of the first adjusting unit to an optimum pressing force for the sheet to be creased based on the first sheet information acquired by the sheet-information acquiring unit and that causes the drive unit to drive the first member and the second member for creasing the sheet at the optimum pressing force.

2. The creasing device according to claim 1, wherein the control unit refers to the first sheet information acquired by the sheet-information acquiring unit and optimum pressing-force information corresponding to second sheet information that has been stored in a storage unit beforehand, thereby determining an optimum pressing force for creasing the sheet serving as a target to be processed.

3. The creasing device according to claim 1, wherein the first sheet information includes at least any one of a size of the sheet, thickness of the sheet, a type of the sheet, and number of sheets included in a sheet bundle.

4. The creasing device according to claim 1, wherein the control unit sets, when creasing is not to be performed, the optimum pressing force to any one of zero and a minimum pressing force.

5. The creasing device according to claim 1, wherein the control unit sets, when creasing is disabled by occurrence of an anomaly, the optimum pressing force to any one of zero and a minimum pressing force.

6. The creasing device according to claim 1, further comprising:

a third member connected to the second member and a back side of the first member with respect to the convex blade;

an elastic member provided between the back side of the first member with respect to the convex blade and the third member; and a second adjusting unit, wherein the elastic member applies an elastic force to the first member and the third member in a direction to separate the first member and the third member from each other and the second adjusting unit adjusts the elastic force of the elastic member by changing a distance between the third member and the first member.

7. An image forming system comprising:

a creasing device that forms a crease on a sheet, the creasing device including:

a first member, extending in a direction perpendicular to a sheet conveying direction, on which a convex blade having a convex cross section is formed;

a second member, provided at a position to face the first member, on which a groove-like concave blade is formed such that the convex blade can be fitted into the concave blade by interposing the sheet therebetween;

a drive unit that causes the first member and the second member to be relatively in contact with and separated from each other so as to interpose, therebetween, the sheet that has been stopped at a predetermined position and to form a crease on the sheet;

a sheet-information acquiring unit that acquires first sheet information of the sheet to be creased;

a first adjusting unit that adjusts a pressing force exerted by the drive unit; and a control unit that sets the pressing force of the first adjusting unit to an optimum pressing force for the sheet to be creased based on the first sheet information acquired by the sheet-information acquiring unit and that causes the drive unit to drive the first member and the second member for creasing the sheet at the optimum pressing force; and an image forming apparatus that forms an image on the sheet.

* * * * *